US007892148B1

(12) United States Patent
Stauffer et al.

(10) Patent No.: US 7,892,148 B1
(45) Date of Patent: Feb. 22, 2011

(54) SYSTEM AND METHOD FOR INTEGRATING EXERCISE EQUIPMENT WITH A WORKSURFACE ASSEMBLY

(75) Inventors: Tamara Lynn Stauffer, Rockford, MI (US); Brian Edward Sanders, Allendale, MI (US); Scott Lee Doolittle, Wyoming, MI (US)

(73) Assignee: Steelcase Inc., Grand Rapids, MI (US)

( * ) Notice: Subject to any disclaimer, the term of this patent is extended or adjusted under 35 U.S.C. 154(b) by 0 days.

(21) Appl. No.: 12/115,935

(22) Filed: May 6, 2008

Related U.S. Application Data

(60) Provisional application No. 60/974,128, filed on Sep. 21, 2007, provisional application No. 60/938,929, filed on May 18, 2007, provisional application No. 60/938,443, filed on May 16, 2007.

(51) Int. Cl.
*A63B 22/00* (2006.01)
*A63B 22/02* (2006.01)

(52) U.S. Cl. ..... 482/54; 482/8; 482/51

(58) Field of Classification Search ..... 482/51–54, 482/908, 910, 148, 92, 8
See application file for complete search history.

(56) References Cited

U.S. PATENT DOCUMENTS

| | | | | |
|---|---|---|---|---|
| 1,919,627 | A | 7/1933 | Fitz Gerald | |
| D266,257 | S | 9/1982 | Ahrens | |
| 4,638,969 | A | 1/1987 | Brown | |
| 4,852,500 | A | 8/1989 | Ryburg et al. | |
| D315,261 | S | 3/1991 | Ng et al. | |
| 5,174,223 | A * | 12/1992 | Nagy et al. | 108/50.01 |
| D339,257 | S | 9/1993 | Scharer et al. | |
| 5,257,701 | A | 11/1993 | Edelson | |
| 5,630,566 | A | 5/1997 | Case | |
| D389,667 | S | 1/1998 | Moore | |
| 5,752,449 | A | 5/1998 | Simon et al. | |
| 5,807,212 | A * | 9/1998 | Nelson | 482/60 |
| 5,813,947 | A | 9/1998 | Densmore | |
| 5,857,415 | A | 1/1999 | Richard | |
| 5,904,104 | A | 5/1999 | Yu | |
| 5,984,839 | A | 11/1999 | Corkum | |
| 5,988,076 | A | 11/1999 | Vander Park | |

(Continued)

OTHER PUBLICATIONS

The DIY Exercise Office, www.makezine.com/blog/archive/2006/03/the_diy_exercise_office.html; 1 page.

(Continued)

*Primary Examiner*—Steve R Crow
(74) *Attorney, Agent, or Firm*—Quarles & Brady LLP

(57) ABSTRACT

A treadmill assembly comprising a substantially horizontal tread assembly including oppositely extending front and rear ends, a tread and a controller for controlling movement of the tread, a support structure extending proximate the rear end of the tread assembly to a distal top end substantially above the rear end of the tread assembly, a table top member mounted to the distal top end of the support structure, the top member including a substantially flat work surface and a front edge, the work surface having dimensions suitable to support a computer keyboard and a control assembly including at least one input button for providing command signals for controlling the controller, the control assembly supported by the table top member adjacent the front edge of the table top member.

17 Claims, 21 Drawing Sheets

U.S. PATENT DOCUMENTS

| | | | | |
|---|---|---|---|---|
| 6,170,406 | B1 | 1/2001 | Klein et al. | |
| 6,224,516 | B1 | 5/2001 | Disch | |
| 6,283,896 | B1 | 9/2001 | Grunfeld et al. | |
| 6,289,794 | B1 | 9/2001 | Carmon | |
| 6,397,761 | B1 | 6/2002 | Moore | |
| 6,614,421 | B1 * | 9/2003 | Selker et al. | 345/168 |
| 6,645,126 | B1 | 11/2003 | Martin et al. | |
| 6,712,008 | B1 | 3/2004 | Habenicht et al. | |
| D493,977 | S | 8/2004 | Rossini et al. | |
| 6,808,475 | B2 | 10/2004 | Kehtbaum | |
| 6,824,230 | B2 | 11/2004 | Probst | |
| 6,908,414 | B1 | 6/2005 | Roadman | |
| D511,636 | S | 11/2005 | Cox | |
| D516,344 | S | 3/2006 | Cox | |
| 2002/0043909 | A1 | 4/2002 | Nielsen | |
| 2006/0247109 | A1 * | 11/2006 | Powell | 482/148 |

OTHER PUBLICATIONS

Treadmill Workstation Experiment; http://hardlikesoftware.com/weblog/2006/12/18/treadmill-workstation-experiment/; 6 pages.

Treadmill Workstation; www.hdcn.net/treadmill/treadmill.htm; 9 pages.

Treadmill Desk; www.treadmill-desk.com;3 pages.

Coolest Workspace Contest: The Treadputer; http://lifehacker.com/software/contest/coolest-workspace-contest--the-treadputer-171537.p...; 6 pages.

A Simple Home Office; www.workandwalk.com/asimplehomeoffice/html; 5 pages.

* cited by examiner

SYSTEM AND METHOD FOR INTEGRATING EXERCISE EQUIPMENT WITH A WORKSURFACE ASSEMBLY

CROSS-REFERENCE TO RELATED APPLICATIONS

This application is related to and claims priority to each of U.S. provisional patent application No. 60/974,128 that is titled "System and Method for Integrating Exercise Equipment with a Worksurface Assembly" which was filed on Sep. 21, 2007, U.S. provisional patent application No. 60/938,929 that is titled "System and Method for Integrating Exercise Equipment with a Worksurface Assembly" which was filed on May 18, 2007 and U.S. provisional patent application No. 60/938,443 that is titled "System and Method for Integrating Exercise Equipment with a Worksurface Assembly" which was filed on May 16, 2007.

BACKGROUND OF THE INVENTION

The present invention relates to exercise workstations and more specifically to a treadmill or other exercise device workstation that includes a treadmill or other exercise device, a work surface, a display device and other accessories that encourage movement and obtain exercise while attending to work activities.

All living beings constantly expend energy, either at rest or during physical activity. Dr. James Levine, a medical doctor in Rochester, Minn., has performed extensive research on the expenditure of a low amount of energy by a living being, referred to as Non-exercise Activity Thermogenesis (NEAT). The NEAT research has found that all individuals store energy in adipose tissues. For example, a lean individual may store two to three months of energy needs in the tissue while an obese person may carry twelve months of their energy needs in the tissue. According to the NEAT research, the cumulative impact of such an energy imbalance over months and years often results in obesity.

Human energy expenditure (EE) includes three principal components: (1) basal metabolic rate (BMR), (2) thermic effect of food (TEF), and (3) activity thermogenesis. BMR is energy expended when an individual is at complete rest in a post-absorptive state. BMR accounts for approximately 60 percent of total daily EE for indivuals with sedentary occupations. The NEAT research suggests that approximately 75 percent of the variability in BMR is predicted by lean body mass within and across species. TEF is an increase in EE associated with the digestion, absorption, and storage of food which accounts for approximately 10-15 percent of total daily EE.

Activity Thermogenesis has two constituents: exercise-related activity thermogenesis and Non-exercise Activity Thermogenesis (NEAT). Unfortunately, a great majority of individuals do not actively participate in exercise and health related activities so that thermogenesis is often negligible and therefore NEAT contributes substantially to the inter- and intra-personal variability in EE. To this end, if three-quarters of the variance of BMR is accounted for by variance in lean body mass and if TEF represents 10-15 percent of total EE, then the majority of the variance in total EE that occurs independent of body weight must be accounted for by NEAT.

NEAT is highly variable and can range from 15 percent of total daily EE in very sedentary individuals to greater than 50 percent in highly active persons. Studies suggest minor changes in physical activity throughout the day can increase daily EE by 20 percent. NEAT is impacted by environment, but is also biologically modulated.

The environmental cues impacting NEAT can be divided into occupational and non-occupational components. With respect to occupational components, individuals with highly active ambulatory jobs can have NEAT values of 1000 kcal/day more than sedentary individuals. In areas of nutritional need, this has implications for starvation-threatened individuals. In affluent countries, industrialization often converts high-NEAT jobs to lower-NEAT jobs which are associated with increased obesity rates. Non-occupation NEAT may include, but is not limited to, activities like dish washing, driving and riding in cars, use of remote controls, using lawnmowers, going through a drive-through at a restaurant, playing a video game, using elevators, using snow blowers, cutting the lawn, etc.

Dr. Levine's research suggests leisure-time sedentariness is a result of the availability and volitional use of pervasive mechanization. Dr. Levine's study found the energetic cost of non-work mechanization is estimated to be approximately 100-200 kcal/day which represents a caloric deficit that potentially could account for the entire obesity epidemic in the United States.

One experiment that suggests NEAT is biologically modulated involved overfeeding individuals where NEAT increased where individuals with the greatest NEAT gains from overfeeding gained the least fat.

Accordingly, one way to increase NEAT in occupational environments has been to construct exercise/workstation configurations that enable users to increase NEAT while simultaneously completing occupational activities. For instance, one solution has been to build treadmill/workstation configurations. While other exercise/workstation configurations are contemplated (e.g., a stair climber/workstation, a bike/workstation, etc.), in the interest of simplifying this explanation, concepts will be described here primarily in the context of exemplary treadmill/workstations.

Here, a typical treadmill includes, among other components, a tread assembly, a vertical support structure, an input/output assembly and hand rails. The tread assembly includes a belt mounted to a horizontal support structure, a motor for driving the belt and a controller for controlling the motor. The vertical support structure extends upward from a rear end of the tread assembly and the input/output assembly is mounted to the top end of the vertical support structure. The input/output assembly, as the label implies, includes components (i.e., buttons and displays (e.g., numerical or video type)) that enable a user to input control commands to the motor controller and to receive feedback regarding an exercise session (i.e., calories burnt, miles traveled, heart rate, time expired, time remaining, etc.). The hand rails include rails that extend generally horizontally from the input/output assembly along side edges of the tread assembly and toward the front end of the tread assembly. The hand rails can be grasped to increase stability during exercise.

Known treadmill/table configurations include either a free-standing table that straddles the front portion of a treadmill where the table forms a work surface that resides in front of a treadmill user or a mounted table top member that is secured to the treadmill hand rails to provide a table top surface. Here, a laptop computer or the like, phone and other devices and work tools (e.g., books, paper reports, etc.) can be placed on the work surface and employed to complete occupational activities (i.e., reading documents, answering e-mails, performing internet searches, etc.) while a user increases the user's NEAT. Exemplary known treadmill tables/trays include dedicated flat screen monitors (FSMs) mounted to support arms adjacent table top surfaces as well as dedicated keyboards, phones and other electronic devices.

While known treadmill/workstation configurations enable users to increase NEAT while working, unfortunately, known configurations have several shortcomings. First, known treadmill/workstation configurations do not have easily accessible control buttons (i.e., start, stop, speed increase, incline increase, etc.) and easily visible input/output assemblies. In this regard, most known treadmill/workstation configurations retrofit a table assembly to an existing treadmill configuration and the table top member resides above the input/output assembly and hand rails or between a configuration user and the input/output assembly and above the hand rails. Where a table top member resides in front of the input/output assembly, the assembly input components (e.g., buttons) and output components are often difficult to see while walking on the tread assembly and the input components are often difficult to reach as a user has to extend over the table top surface to access the input components. Here, difficulty in accessing/seeing the input/output assembly is exacerbated when a laptop or other computer components reside on the table top surface between the user and the input/output assembly. Similarly, where a table top member resides above the input/output assembly, access top and view of the input/output assembly is blocked or severely impeded making it difficult for a user to control the tread assembly and to ascertain the current status of NEAT activities.

Second, known treadmill/workstation configurations include table top members that impede access to the lateral hand rails which reduces user stability. Here, known treadmill/workstation configurations usually include table top members positioned at least in part above the hand rails which often completely blocks access to those rails. Where the top member does not completely block access to rails, the top member usually substantially blocks access to the rails so that only the ends of the rails are exposed which can be difficult to grasp.

Third, while treadmill/workstation users like to be able to periodically check the status of their activities by observing the output components of the input/output assembly, it has been recognized that changing output can be distracting to a treadmill/workstation user while the user is trying to complete work tasks. For instance, when a treadmill/workstation user is reading a document, changing digital readouts that reflect treadmill activities below a computer display screen can distract a station user and adversely affect completion of the tasks. In cases where a top surface resides between an input/output assembly and a user on the tread assembly so that the output components are observable while using the tread assembly, the changing output is distracting.

One solution to deal with blocked hand rails has been to provide a rail along the edge of the table top surface facing a tread assembly user. Unfortunately this solution results in the workstation key board being further away from the workstation user which can be ergonomically incorrect.

Fourth, while treadmill/workstation configurations are useful, these configurations often require dedicated workstation components that make it necessary for a user to purchase a completely different set of duplicate components to configure a more typical workstation for normal use. To this end, most treadmill/workstation users will only use a treadmill/workstation during a portion of a workday (e.g., for 1-2 hours) and therefore require some other more conventional workstation to support activities during other times of the day. In many cases, while users recognize advantages of a treadmill/workstation, because most of their work day will be spent at a conventional workstation, the users cannot justify the added costs associated with an additional treadmill/workstation and they forego the benefits associated therewith.

Fifth, in cases where a table assembly straddles a treadmill, often the table assembly is relatively narrow in depth and therefore is not very sturdy. In these cases, if a user grabs onto the table assembly it is believed that the table assembly and components supported thereby could be toppled which could damage the supported components.

Sixth, the table top surface of known treadmill/workstations is not optimally sized. To this end, some treadmill/workstation top members have top surfaces that are only large enough to support a laptop computer or the like and therefore are too small for facilitating many occupational activities. Other treadmill/workstation top members include large work surfaces to enable users to spread out materials thereon during tread assembly use. When a top surface is too large, users are tempted to spread out materials thereon at locations that require the user to reach over extended spaces to access the materials which can cause instability.

Seventh, most treads on treadmills are wide and enable a user to walk along the tread at various locations with respect to the width (i.e., at a central location, at a left lateral location, at a right lateral location, etc.). In the case of typical exercise treadmills, wide treads are fine as a treadmill user's attention is typically directed forward during use and the user naturally centers on the tread width. In fact, in at least some cases where users run on a mill, a wide tread may be necessary for users to avoid inadvertently stepping off the tread during activities. However, in the case of a treadmill workstation, it has been recognized that where a table top is relatively large and a tread width is relatively wide, users have a tendency to spread out materials across the top surface and to move around to different locations with respect to the tread width. For instance, where a document is located adjacent a left lateral edge of a top member, a user on a wide tread may move over to the left side of the tread when reaching for the document. Here, the relatively wide tread gives the user the sense that moving toward the left edge of the tread is OK and even encouraged. When moving toward a tread edge users can misjudge their location on the tread and have been known to inadvertently step off the tread at times.

Eighth, most treadmills have relatively high maximum speed limits that encourage users to run or jog on the tread during use. Where a user jogs or runs, the user cannot typically concentrate on a display screen or use an input device like a keyboard very well. In addition, jogging and other aerobic exercise is not consistent with NEAT exercise principles.

Ninth, when a station user places a keyboard, papers, etc., on the top surface of a treadmill table top, it has been observed that there is a tendency to place those materials adjacent or even hanging off a front edge of the top member. Here, in the event that a station user needs to grasp the table edge to maintain balance, loose papers and/or a loose keyboard or the like may impede a good grip on the table edge and therefore the top member can often be rendered ineffectual as a stabilizing structure.

Thus, what is needed is a sturdy treadmill/table configuration that includes easily accessible treadmill control buttons, an easily accessible hand rail that does not interfere with access to a keyboard, optionally accessible treadmill output components and that includes a work surface that is sized to facilitate many different types of occupational activities without being too large so that a user cannot easily reach materials supported there by. In addition, it would be advantageous if a treadmill/workstation where transformable so that the station could be used with a chair instead of with a tread assembly at times.

BRIEF SUMMARY OF THE INVENTION

It has been recognized that an exercise workstation can be configured that overcomes at least some of problems associated with known prior art stations by providing a controller interface assembly that includes at least a subset of control buttons adjacent a front edge of a table top member so that the buttons are easily accessible when the exercise equipment is employed. Thus, for instance, an interface assembly including at least a stop button may be mounted to the undersurface of a table top member adjacent a front edge thereof for easy access. As another instance, a interface may be built into the front edge of the top member or mounted to the top surface or within the top surface adjacent the front edge.

It has also been recognized that a handle can be provided along a table top front edge for grasping by a station user during NEAT activities. In particularly advantageous embodiments the handle may extend along the entire front edge of the top member and may extend upward from a top surface of the top member to form a lip or rib along the front edge. Here, the lip/rib serves several purposes. First, the lip serves as a stabilizing handle that can be gripped at any location. Second, where a keyboard or other input device is used at the station, the lip can serve as a wrist rest adjacent the keyboard or other include device. Third, the lip acts to discourage placing materials (e.g. papers, devices, etc.) immediately adjacent or in locations that overlap the front edge of the table member and therefore the lip is unobstructed as a supporting structure.

Moreover, it has been recognized that a treadmill assembly having certain characteristics/limitations is optimal for use as part of an exercise workstation. To this end, tread speed should be limited to a low maximum speed (e.g., 1-3 miles per hour) so that users of the treadmill are encouraged to walk instead of run.

In addition, in at least some embodiments of the present invention tread width is relatively narrow when compared to a typical treadmill to encourage users to stay at a central location with respect to the tread and with respect to equipment being used on the station table top. In this regard, where a station user knows that a tread is narrow, it has been observed that the user generally stays centrally located on the tread and does not move from edge to edge and therefore inadvertent stepping off the tread is avoided.

Moreover, it has been recognized that various types of exercise workstations can be configured that enable a table assembly that forms part of the station to be used in a more conventional way when the station is not to be used for exercise purposes. Exemplary stations of this type include table tops that have work surface segments for use during exercise and separate segments for typical non-exercise use, tops that rotate between an exercise juxtaposition and a non-exercise juxtaposition, tops that slide and treadmills or the like that can be removed from table assemblies so that the table assemblies can be use without the treadmills or the like.

To the accomplishment of the foregoing and related ends, the invention, then, comprises the features hereinafter fully described. The following description and the annexed drawings set forth in detail certain illustrative aspects of the invention. However, these aspects are indicative of but a few of the various ways in which the principles of the invention can be employed. Other aspects, advantages and novel features of the invention will become apparent from the following detailed description of the invention when considered in conjunction with the drawings.

DETAILED DESCRIPTION OF THE INVENTION

Figure 1:
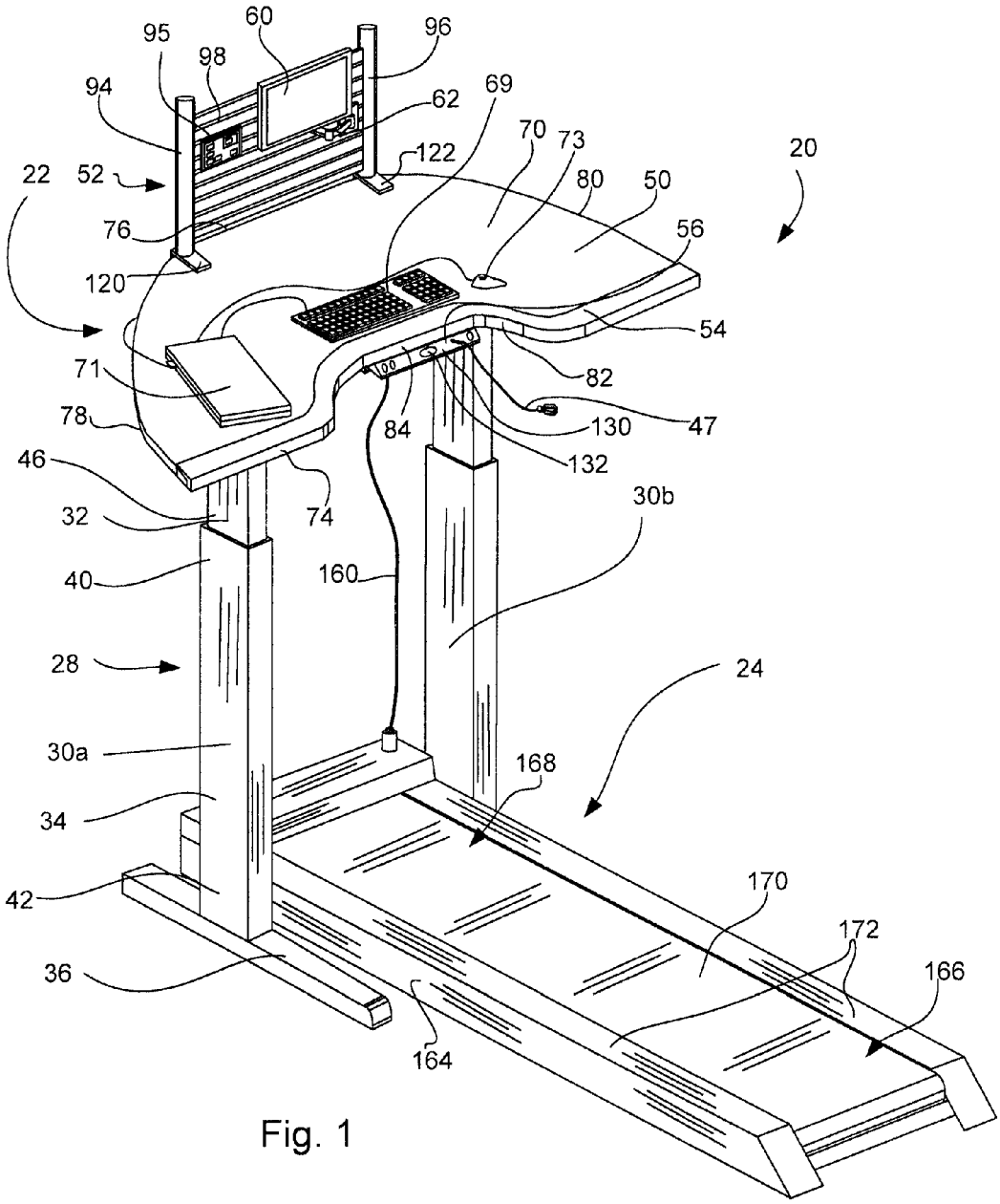
FIG. 1 is a perspective view of an exemplary workstation assembly including a table assembly and a treadmill assembly according to at least one embodiment of the present invention.

Referring now to the drawings where like reference numerals correspond to similar elements throughout the several views and, more specifically, referring to FIGS. 1 through 12, a first exemplary embodiment of a workstation assembly 20 that is consistent in at least some aspects of the present invention is illustrated. Workstation assembly 20 includes a table assembly 22 and a treadmill assembly 24.

Figure 2:
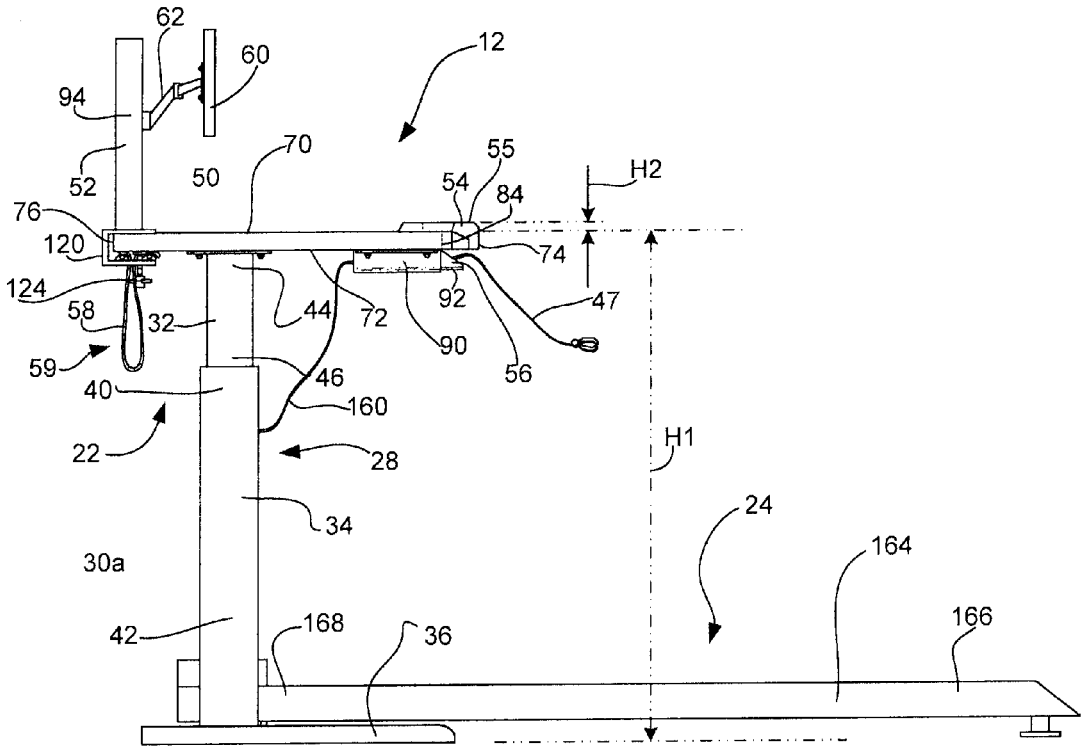
FIG. 2 is a side plan view of the assembly of FIG. 1.

Table assembly 22 includes a support structure 28, a tabletop member 50, a vertical slat wall assembly 52, a handle/wrist rest member 54, a control input assembly 56, and a wire management assembly 59 (see FIG. 2). Support structure 28 includes first and second leg subassembly 30*a* and 30*b*, respectively, and a substantially horizontal crossbar member 38 (see FIG. 10). Each of the leg subassemblies 30*a* and 30*b* is similarly constructed and operates in a similar fashion and therefore, in the interest of simplifying this explanation, only subassembly 30*a* will be described here in any detail.

Figure 4:
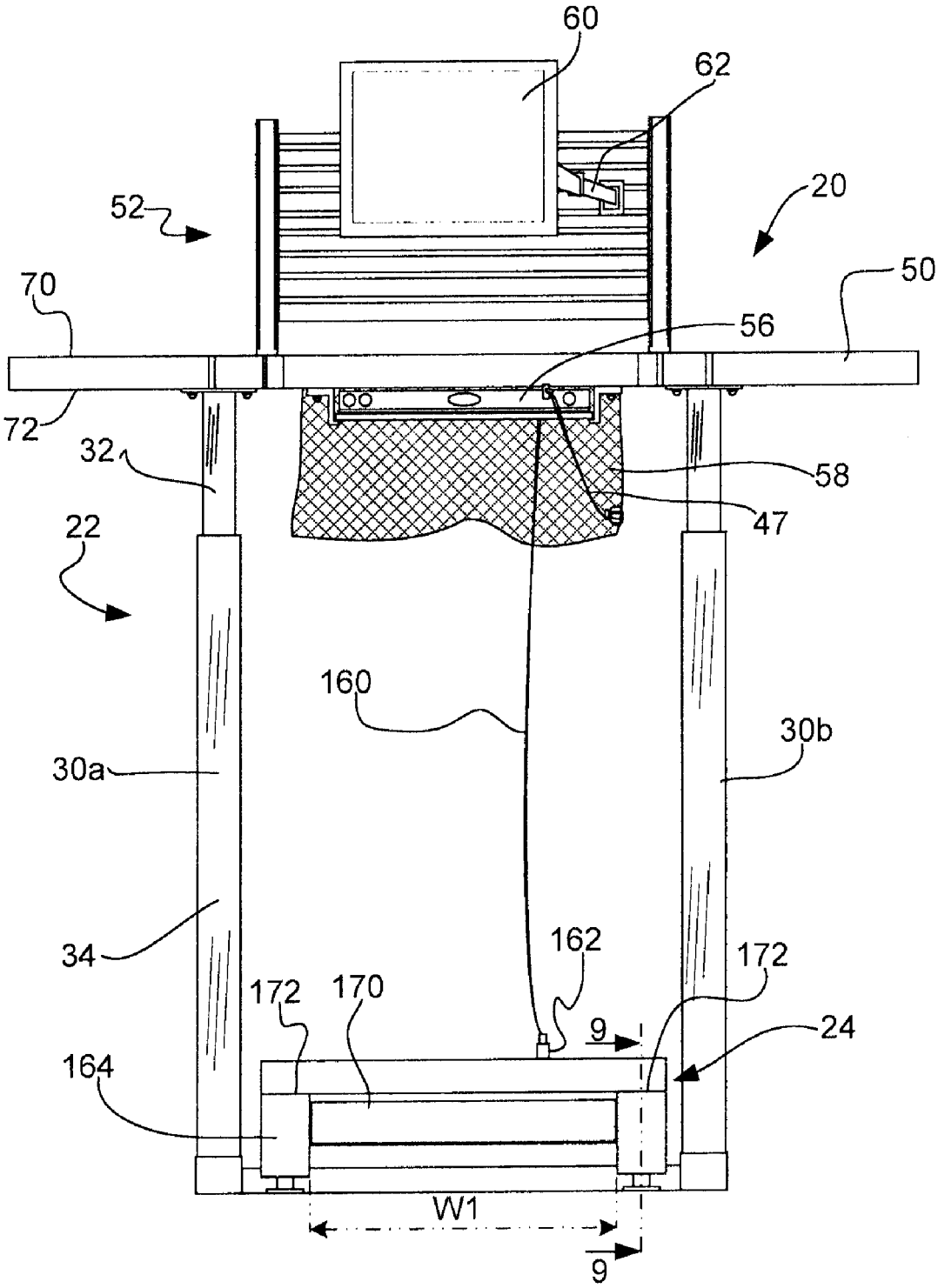
FIG. 4 is a front plan view of the assembly of FIG. 1.

Referring specifically to FIGS. 1, 2, and 4, leg subassembly 30*a* includes top and bottom telescoping leg members 32 and 34, respectively, and a foot member 36. Bottom leg member 34 is a tube-like member having a rectangular cross-section and having top and bottom ends 40 and 42, respectively. Member 34 forms an internal passage way or channel (not labeled) along its length for receiving member 32. Member 32 has a shape that is similar to the shape of member 34, albeit having a smaller size cross-section so that member 32 can be received within the channel formed by member 34 for sliding motion in and out of the channel. Member 32 has top and bottom ends 44 and 46, respectively (see FIG. 2). As shown in FIGS. 1, 2 and 4, member 32 is received within member 34 so that the top end 44 thereof extends therefrom and generally in an upward direction.

Here, although not illustrated or described in great detail, it should be appreciated that some type of height adjustment mechanism or height adjustment assisting mechanism may be provided within the channel formed by member 34 for adjusting and maintaining the position of member 32 within member 34 thereby adjusting a height dimension (see H1 in FIG. 2) as should be appreciated by those skilled in the art. The height adjustment mechanism may include an electrically powered motor, a spring, or coil loaded mechanism or any other height adjustment mechanism known in the art.

Referring still to FIGS. 1 and 2, foot member 36 is an elongated ridge member and is mounted near bottom end 42 of member 34 and extends along a direction substantially perpendicular to the length of member 34. Foot member 36 may be secured to the bottom end of member 34 in any manner known in the art such as, for example, via screws, bolts, or other types of mechanical fasteners.

Figure 10:
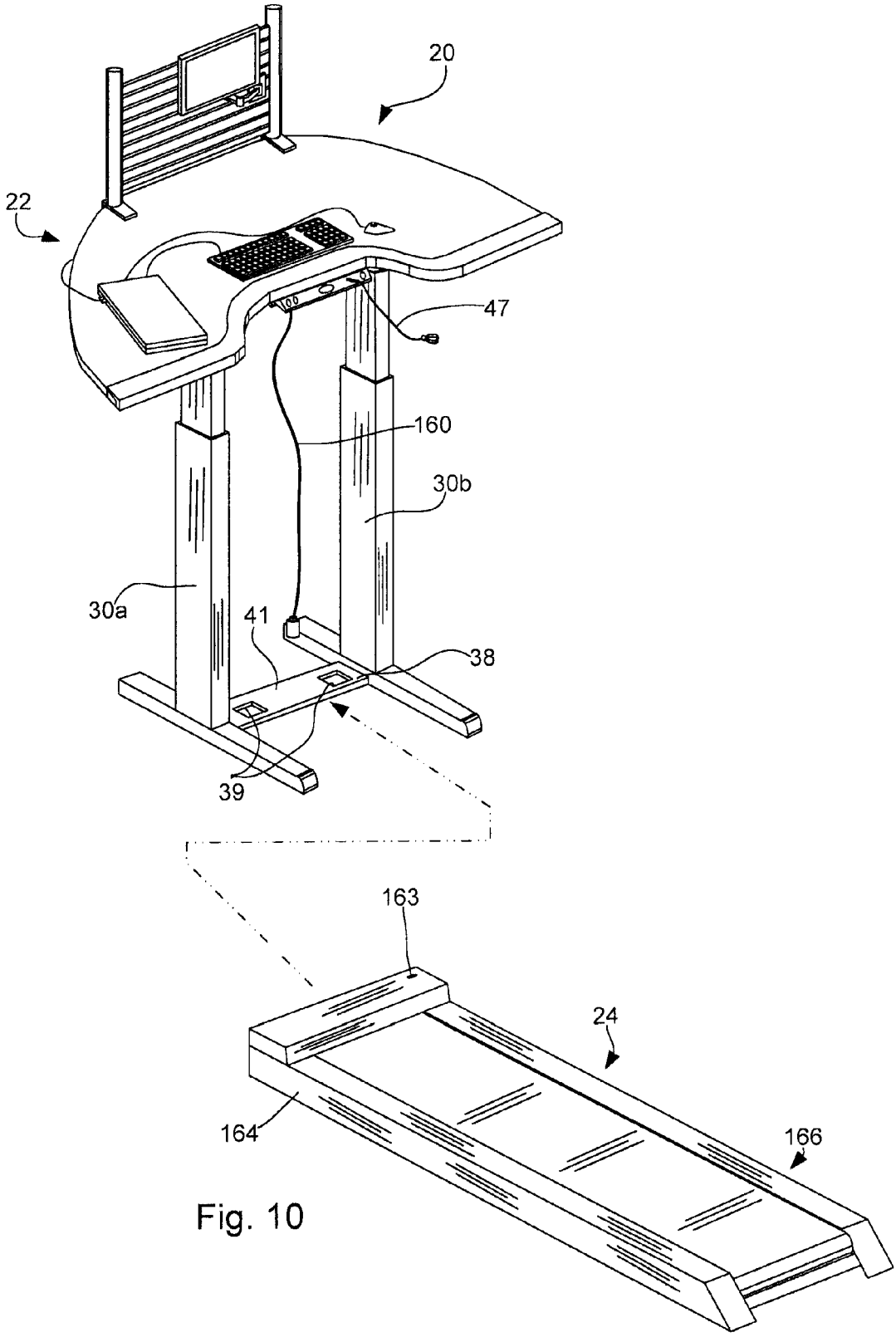
FIG. 10 is a perspective view of the assembly of FIG. 1, albeit where the treadmill assembly has been separated from the table assembly.

Referring now specifically to FIG. 10, crossbar or base plate member 38 is an elongated rigid and substantially rectilinear member that extends between foot member 36 associated with leg subassembly 30*a* and a similar foot member (not labeled) associated with leg subassembly 30*b*. Thus, member 38 secures the foot members of subassemblies 30*a* and 30*b* together adjacent their lower ends. Member 38 forms a substantially flat top surface 41 and forms two treadmill receiving openings 39 for receiving wheels or other coupling structure (see 180 in FIG. 7) that protrudes from an undersurface of treadmill assembly 24 for linking the treadmill assembly to table assembly 22 in a manner described in more detail below. While crossbar member 38 is described as mounted between foot members 36, it should be appreciated that member 38 may also be secured to undersurfaces of foot members 36 via screws or the like. In any event, member 38 is substantially immediately adjacent a supporting floor structure in at least some embodiments after installation.

Referring once again to FIGS. 1, 2 and 4, tabletop member 50 includes a top surface 70 and a bottom or undersurface 72, a front edge 74, a rear edge 76 and first and second lateral or side edges 78 and 80, respectively. Front edge 74 includes straight edge portions at first and second ends and a concave portion 82 at a central location along front edge 74 where the concave portion further includes a straight central portion 84 which is recessed from the straight end portions. Here after straight central portion 84 may also be referred to as the recessed portion of front edge 74. Rear edge 76 is straight and is substantially parallel to straight edge portion 84 of front edge 74. Lateral edges 78 and 80 are curved. First lateral edge 78 curves from the first end of front edge 74 to a first end of rear edge 76 while second lateral edge 80 curves from the second end of front edge 74 to a second end of rear edge 76 where edges 78 and 80 converge toward each other along the direction from the front edge toward the rear edge.

Figure 5:
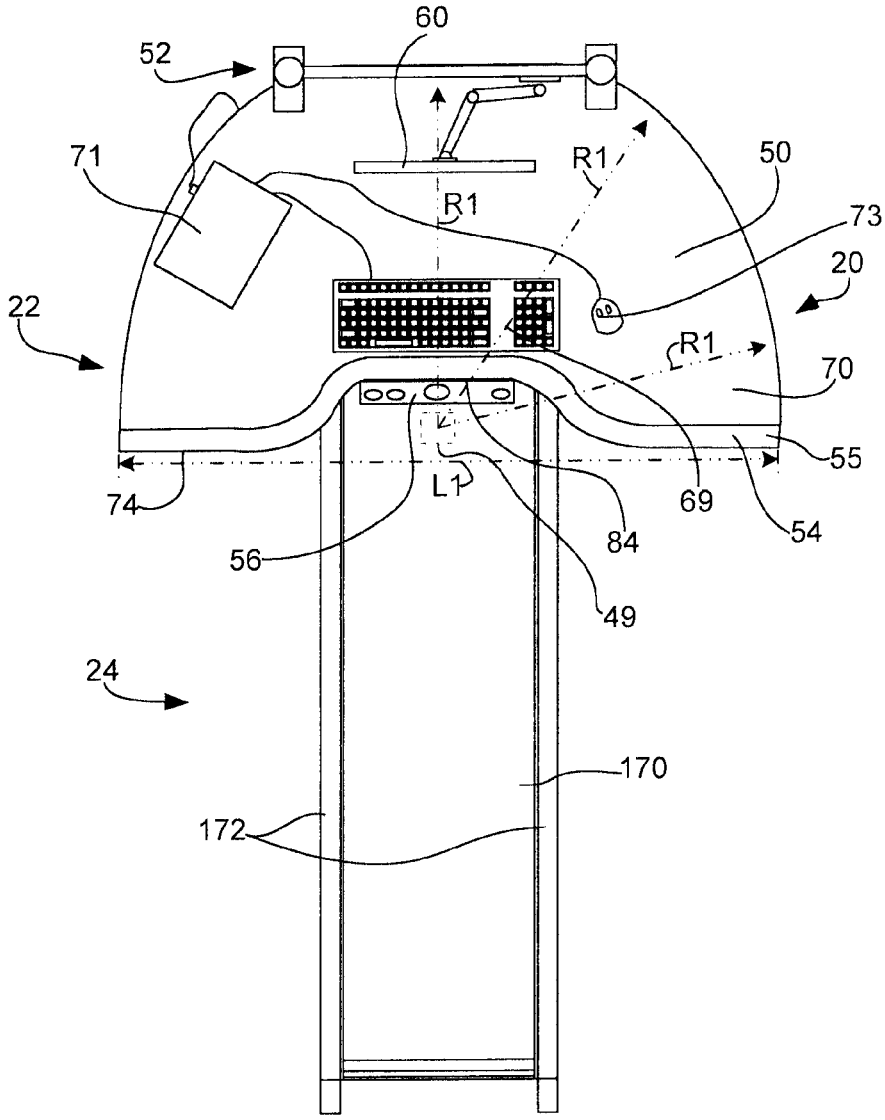
FIG. 5 is a top plan view of the assembly of FIG. 1.

Referring to FIG. 5, straight edge 74 has an end-to-end length dimension L1 that is between three and six feet and, in some cases, is approximately five feet so that portions of top surfaces 70 adjacent the ends of edge 74 are no more than three feet from a central point 49 adjacent recessed portion 84 and, where edge 74 is approximately five feet, so that portions at the ends of edge 74 are no more than two and one-half feet from central point 49 adjacent portion 84. Curved edges 78 and 80 generally arc around central point 49 so that no part of top surface 70 is more than two to three feet away from point 49 (see R1 in FIG. 5 that is substantially consistent along any radial line from point 49). Thus, top member 80 is designed so that a workstation user of average proportions can reach any location above member 50 without excessive stretching and therefore user balance is relatively easy to maintain. In particularly advantageous embodiments the length L1 is approximately fifty inches and the depth between front and rear edges is approximately thirty-two inches.

Referring to FIGS. 1, 2, and 5, handle/wrist rest member 54 extends along the entire length of front edge 74 between lateral edges 78 and 80. As best seen in FIG. 2, handle 54 extends upward from the top surface 70 of top member 50 (i.e., from a work surface plane defined by top surface 70) a height H2 and forms a top surface 55 that is substantially parallel to top surface 70 of member 50. In at least some embodiments, member 54 has a depth dimension D1 (see FIG. 5) that is between one and three inches which is particularly suitable for gripping, wrist support and discouraging placement of materials (e.g., papers, books, etc.) thereon. Here, it has been recognized that persons using the illustrated systems may be inclined to place papers and the like along the front edge of top member 60 so that the materials overhand the front edge somewhat. This activity can impede access to the front edge when a stabilizing structure is required. By placing a substantial member 54 (e.g., substantial in height and depth) along the front edge, system users are far more inclined to place materials inboard of the handle member 54 so that access to member 54 is unobstructed.

As the label implies, member 54 is usable as a handle for gripping by a person located adjacent front edge 74 of member 50. To this end, height H2 may be anywhere between ¼ of an inch and two inches and, in particularly advantageous embodiments, is between ½ inch and one inch. Thus, member 54 essentially forms a rib that extends upward along front edge 74 for gripping purposes. In addition, the portion of handle member 54 adjacent recessed edge portion 84 of front edge 74 is usable as a wrist rest when a person adjacent edge 74 is using a keyboard (see 69) or a mouse (see 73) adjacent the handle/wrist rest member.

Member 54 may be secured to front edge 74 in any manner known in the art including, but not limited to, adhesive, mechanical fasteners (e.g., screws, bolts, etc.), etc. In some cases, member 54 may be integrally formed with front edge 74. In some cases member 54 may be a rigid member while in other cases member 54 may be formed of a foam (e.g., urethane) or gel covered material along its entire length or along portions thereof adjacent recessed edge portion 84 where a station user may opt to rest his/her wrists during use or use the member as a handle. In at least some cases, the top edges of member 54 may be angles or rounded to eliminate sharp edges.

Referring once again to FIGS. 1, 2 and 4, slat wall assembly 52 includes first and second vertical post members 94 and 96, respectively, a segment of slat wall 98 and first and second C bracket subassemblies 120 and 122. Post 94 is secured to C bracket subassembly 120 while post 96 is secured to C bracket subassembly 122. Slat wall segment 98 extends between and is secured to facing surfaces of post assemblies 94 and 96.

C-bracket subassemblies 120 and 122 are similar in construction and operation and therefore only subassembly 120 will be described here in detail. Subassembly 120 includes, as the label implies, a C-shaped bracket member and a locking bolt 124 where bracket member forms a channel in which the rear edge 76 of top member 50 is receivable (see FIG. 2). Locking bolt 124 is received through a threaded hole (not labeled) in a portion of the C-shaped member and can be rotated to secure the C-shaped bracket member onto rear edge 76 as best shown in FIG. 2.

When bracket subassemblies 120 and 122 are both secured to rear edge 76 as shown in FIG. 1, posts 94 and 96 extend upward from the brackets and the slat wall segment 98 traverses the distance between the posts 94 and 96 substantially above rear edge 76. As known in the art, slat wall segment 98 includes elongated grooves and channels to which various accessories can be mounted including, but not limited to, pencil holders, paper holders, phone support stands, lighting accessories, file holders, shelving units, small cabinets, etc. In FIGS. 1, 2 and 4 an articulating flat panel monitor arm 62 is shown mounted to slat wall segment 98 where arm 62 supports a flat panel monitor 60 in any of several different locations for viewing by a station user. Arm 62 and display monitor 60 may slide horizontally along the wall channel between posts 94 and 96.

Referring now to FIGS. 1, 2, 4, and 5, control interface assembly 56 includes control input and output devices including buttons, visual output devices (e.g., LEDs, LED readout devices, etc.), monitor ports, etc., usable for controlling treadmill assembly 24 and receiving output from exercise monitoring devices and the like associated with the treadmill. To this end, referring also to FIG. 3A, an exemplary interface is illustrated and includes a stop button 132, slow and fast buttons 250 and 252, respectively, a start button 254, readout devices collectively identified by numeral 256, and a female "deadman" port 255. As well known in the treadmill arts, start button 254 can be selected to commence movement of a tread (see 170 in FIG. 1) on the treadmill. Slow and fast buttons 250 and 252, respectively, can be used to decrease and increase the speed of the treadmill tread within specific limits. Stop button 132 can be selected to immediately stop movement of the tread 170. Readout devices 256 can be used to indicate various operating characteristics including exercise time, calories burnt, time of day, pulse rate, tread speed, etc. Dead man port 255 receives a male pin connected to a cord and a clip collectively identified by numeral 47. Here, the clip can be clipped to a treadmill user's shirt or the like. If the user falls off the treadmill or otherwise leaves the treadmill for some reason, the cord is pulled by the user and the pin secured thereto is pulled from output port 255 and operates to automatically stop tread rotation.

Figure 3:
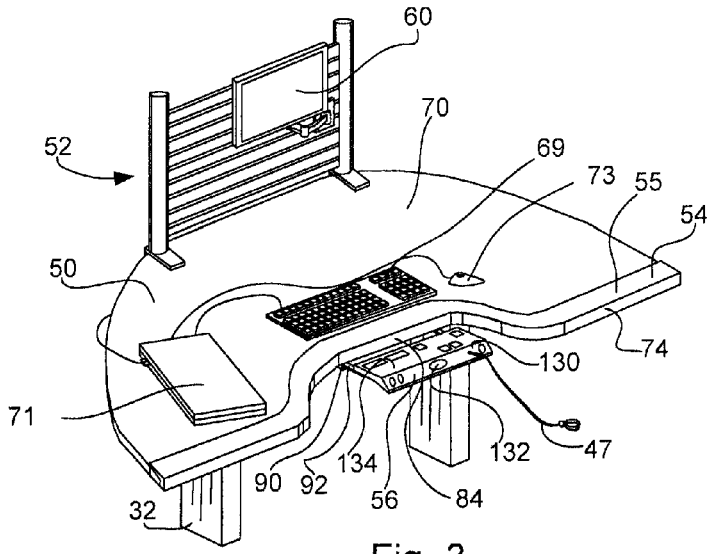
FIG. 3 is a perspective view of a top portion of the table assembly of FIG. 1, albeit where a control assembly has been slid forward into a use position.
Figure 3A:
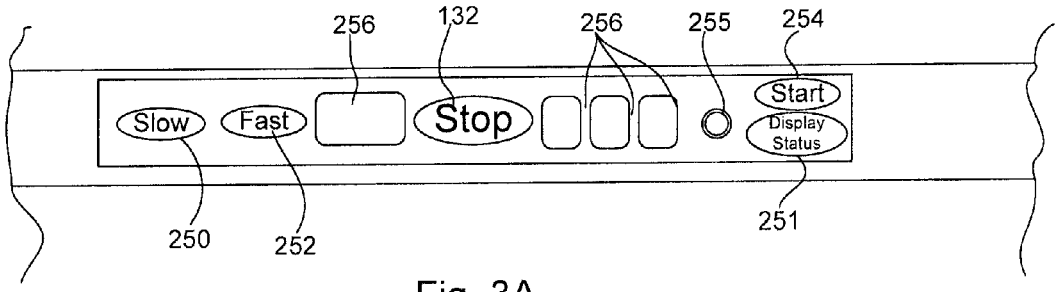
FIG. 3A is a front perspective view of an exemplary control assembly consistent with at least some aspects of the present invention.

Referring now to FIGS. 2 and 3, in at least some embodiments of the present invention, the control assembly 56 is supported by a tray 92 that is received by tracks 90 for sliding motion. Here, tracks 90 may be secured to undersurface 72 of top member 50 as shown in FIG. 2 and the tray along with the supported control assembly 56 may be slid between a stored or retracted position as shown in FIG. 2 and an extended position as shown in FIG. 3 so that most of the input and output devices associated with the control assembly 56 can be located out of view below tabletop member 50 when desired and so that only particularly important input and output devices such as the stop button 132 are accessible adjacent the recessed front edge 84 of top member 50 at all times. Thus, for instance, input buttons for setting a mode of operation or the duration of an exercise activity or the like may be stored below the tabletop member after those parameters have been set while the stop button and the slow and fast buttons may be accessible adjacent the top edge of the tabletop at all times. As seen in FIGS. 1 and 2, a connecter cable 160 connects control assembly 56 to treadmill assembly 24 to facilitate control and feedback activities. The present disclosure also contemplates control assembly 56 capable of wirelessly communicating with the controller for the treadmill assembly 24.

Figure 3B:
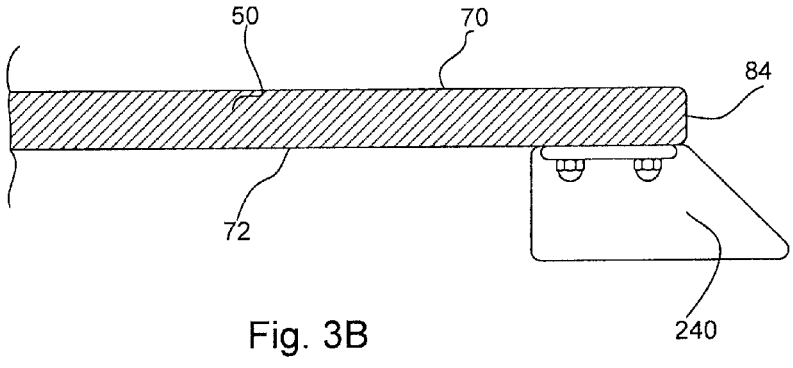
FIG. 3B is a cross-sectional view showing a control assembly mounted to the undersurface of a table top as consistent with at least some aspects of the present invention.
Figure 3C:
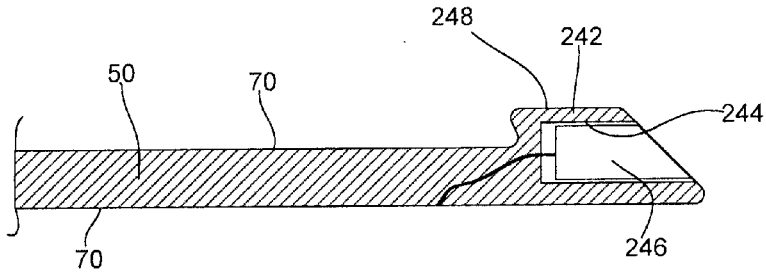
FIG. 3C is similar to FIG. 3B, albeit showing a handle/wrist support that is integrally formed along a front edge of a table top member where a control assembly has been built into the support structure.
Figure 3D:
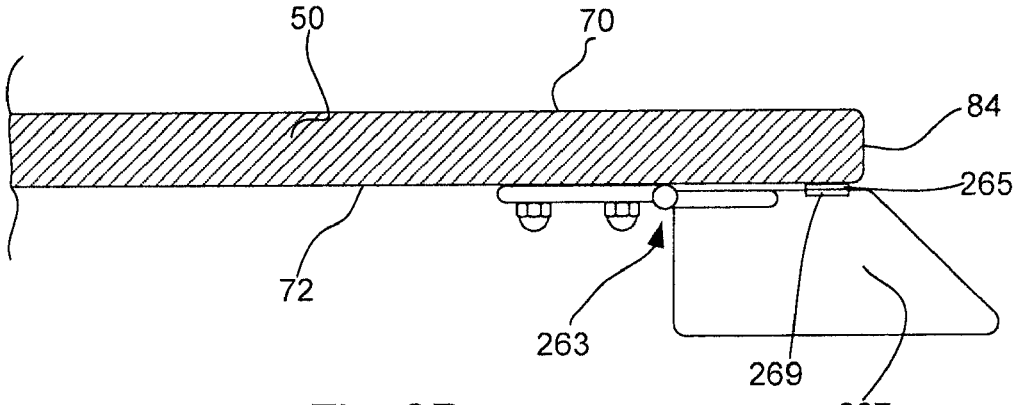
FIG. 3D is a cross-sectional view showing a break away interface assembly mounted adjacent a front edge of a table top.
Figure 3E:
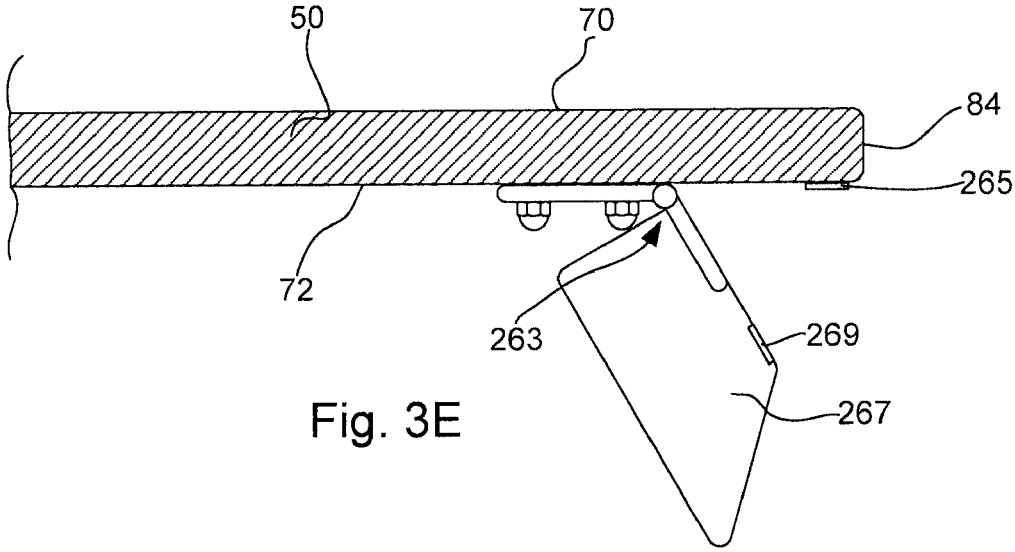
FIG. 3E is similar to FIG. 3D, albeit showing the interface assembly in a detached orientation.

Referring now to FIG. 3B, in at least some embodiments it is contemplated that a control interface 240 (akin to interface 56 described above) may be mounted or secured in a single position to the undersurface 72 of a top member 50 adjacent front edge 84. In FIG. 3B, screws are showing mounting interface 240 to undersurface 72 and here interface 240 is not slidable to retracted and used positions. Referring to FIG. 3C, yet another embodiment showing a control assembly interface 246 is shown. In FIG. 3C, a handle/wrist rest member 242 (akin to member 54 described above) including a top surface 248 is integrally formed with top member 50 and forms a channel or recess 244 in which interface 246 is mounted. In still other embodiments a control interface may be mounted adjacent the front edge 74 via a breakaway mechanism so that if force greater than a certain threshold is applied to the interface, the interface releases and moves out of the way. To this end, see FIGS. 3D and 3E that show an interface 267 that is mounted to undersurface 72 via a hinge 263. Here, interface 267 includes a metallic member 269 along a top surface 279 and a magnet 265 is mounted to undersurface 72 adjacent front edge 84. When member 269 contacts magnet 265, member 269, and magnet 265 cooperate to maintain interface 267 in the use position shown in FIG. 3D. When a strong force is applied downwardly to interface 267, interface 267 becomes detached as shown in FIG. 3E and pivots downward and out of the way. To reattach interface 267 the interface is simply pivoted upward until member 269 contacts magnet 265. Other breakaway configurations contemplated include Velcro, mechanical friction type couplers, etc.

Referring now to FIGS. 2 and 4, a cable management assembly 59 includes a net 58 mounted to the undersurface 72 of top member 50 adjacent rear edge 76. Net 58 forms a space in which excess computer, monitor, control and feedback cables may be stored. In the illustrated embodiment, wing nut type screws are provided to hold net 58 to undersurface 72. Other mechanical fastening mechanisms (e.g., hooks, etc.) may be provided for securing net 58 to members 50.

Figure 7:
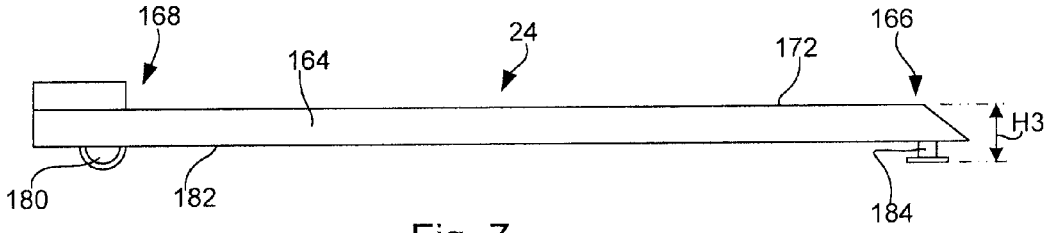
FIG. 7 is a side plan view of the treadmill assembly of FIG. 1.
Figure 8:
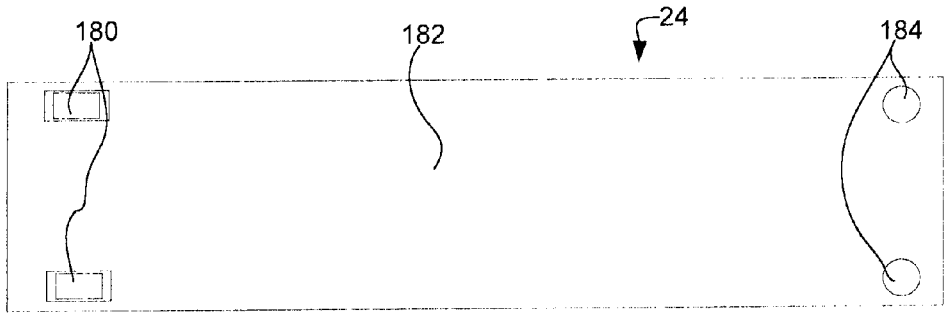
FIG. 8 is a bottom plan view of the assembly of FIG. 7.

Referring now to FIGS. 1, 2, 4, 5, and 7 through 9, treadmill assembly 24 includes a treadmill base/housing structure 164, a tread 170, a port 163 (see FIG. 10) for connecting cable 160, wheels 180 (see FIGS. 7, 8 and 9) and height adjustment glides 184 (see FIGS. 7 and 8). The construction, design and operation of treadmill housing/base structures like structure 164 and tread 170 as well as wheels 180 and height adjustment mechanisms 184 are well known in the art and therefore will not be described here in detail. Here, it should suffice to say that housing/base structure 164 has front and rear ends 166 and 168, respectively, and that tread 170 is mounted in structure 164 for rotation with an exposed top surface.

Figure 9:
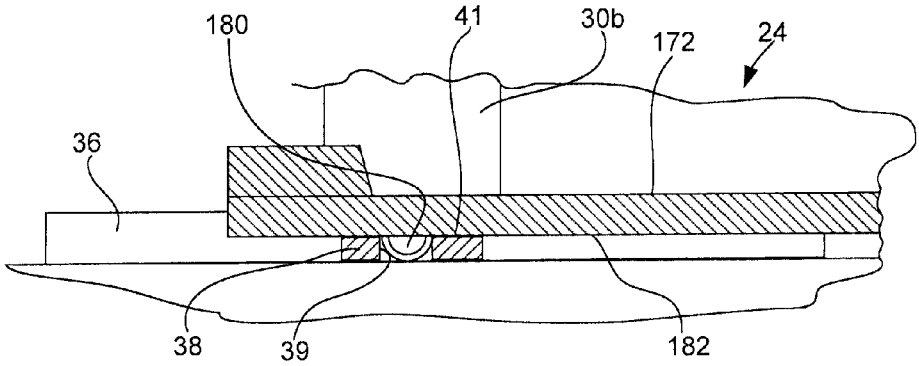
FIG. 9 is a cross-sectional view taken along the line 9-9 in FIG. 4.

Wheels 180 are mounted to structure 164 and extend from undersurface 182 thereof adjacent rear end 168. Wheels 180 are spaced apart a distance similar to the dimension defined by the treadmill receiving openings 39 (see FIG. 10) such that, as shown in FIG. 9, the wheels 180 are simultaneously receivable therein. As shown in FIG. 9, when wheels 180 are received within openings 39, the undersurface 182 of structure 164 rests on the top surface 41 of crossbar member 38 so that, in effect, the wheels and openings 39 register assembly 24 with table assembly 22 and effectively secure the two assemblies together unless affirmatively and purposefully taken apart. Once assembly 24 is coupled to assembly 22, the relative juxtaposition of the two assemblies should be maintained. In addition, to maintaining relative positions, the assembly coupling also results in a more stable table assembly 12 as the added mass of treadmill assembly 24 reduces the likelihood of the table assembly 22 tipping over when a station user grasps handle member 54. Although not shown, coupling mechanisms other than wheels 180 and openings 34 are contemplated.

Referring to FIGS. 7 and 8, height adjustment glides 184, as the label implies, are provided to adjust the height of the portion of undersurface 182 adjacent the glides. Glides 184 are provided near front end 166 of structure 164 and can be adjusted by rotation thereof. Although not illustrated, glides 184 may include foot members that form threaded channels that receive threaded shafts for adjustment purposes. Glides of this type are known in the art and therefore are not described here in detail.

Although not illustrated, it should be appreciated that assembly 24 (or interface assembly 56) also includes a control processor and a database for storing software run programs by the processor to control tread speed to generate feedback and operating information and to provide output to a workstation user via interface assembly 56. Thus, as a workstation user starts and stops the tread and increases and decreases the tread speed via assembly 56, the control processor would control tread 170 accordingly and provide feedback to the user.

In at least some embodiments tread speed is limited to within a range having a relatively low maximum speed. For example, in at least some embodiments the maximum speed of tread 170, including a breakaway speed, will be less than three miles per hour and in some cases it will be approximately one mile per hour. This relatively low maximum tread speed limit is believed to be advantageous as it maintains user exercise below aerobic levels and within a speed range that enables the workstation user to effectively use a computer and other devices on top surface 70.

Referring specifically to FIG. 4, tread 170 has a width dimension W1. In at least some embodiments width dimension W1 will be much narrower than the width of a tread on a typical exercise treadmill. Thus, for example, in at least some embodiments, width W1 is less than three feet and in particularly advantageous embodiments width W1 will be in the range of 18 inches to twenty-four inches. Here, the reduced width W1 has several advantages. First, by reducing width W1, a less expensive and relatively small foot print treadmill assembly 24 is provided where, in at least some cases, less energy is required to drive the tread and space required for the assembly is reduced. In this case, because the speed of tread 170 is kept relatively low, a person walking on the tread should have no problem keeping within the confines of the lateral edges of the tread (this is not always the case where a treadmill user is running on a tread at a high speed which often requires a wider tread). The narrower tread also enables a workstation user to relatively easily and comfortably step off the tread 170 and onto lateral standing or foot surfaces 172 (see FIG. 4) where the person can stand comfortably for some time when necessary for resting purposes or, in some cases, for concentrating on information presented via display 60 or for using one of the computer input devices such as the keyboard 69, mouse 73, etc. In addition, the narrow tread discourages station users from moving around to tread edges while retrieving materials/devices that reside along lateral table top edges (see 78 and 80 in FIG. 1).

Referring to FIG. 7, base structure 164 has a step-up height dimension H3 that is relatively low (e.g., between ½ and seven inches) when compared to typical treadmill step up heights which make tread boarding and unboarding relatively easy.

Referring to FIG. 1, top member 50 is secured to the top ends of leg subassemblies 30*a* and 30*b* via screws or the like and slat wall assembly 52 is mounted to member 50 above rear edge 76 via bracket assemblies 120 and 122. As shown in FIG. 1, a laptop computer 71, keyboard 69 and a mouse 73 or other input device are placed on top surface 70 for support. Display screen/monitor 60 is mounted to slat wall assembly 52 and interface assembly 56 is mounted to top member 50 adjacent front edge 74. Assembly 24 is coupled to table assembly 22 via wheels 180 received in openings 39 (see FIG. 10) and cable 160 is used to link assembly 24 to interface device 56. After assembly, a station user can place work items on surface 70, can use keyboard 69 and mouse 73 to run programs and has easy access to interface assembly 56 for controlling treadmill 24 and receiving workout feedback.

Figure 12:
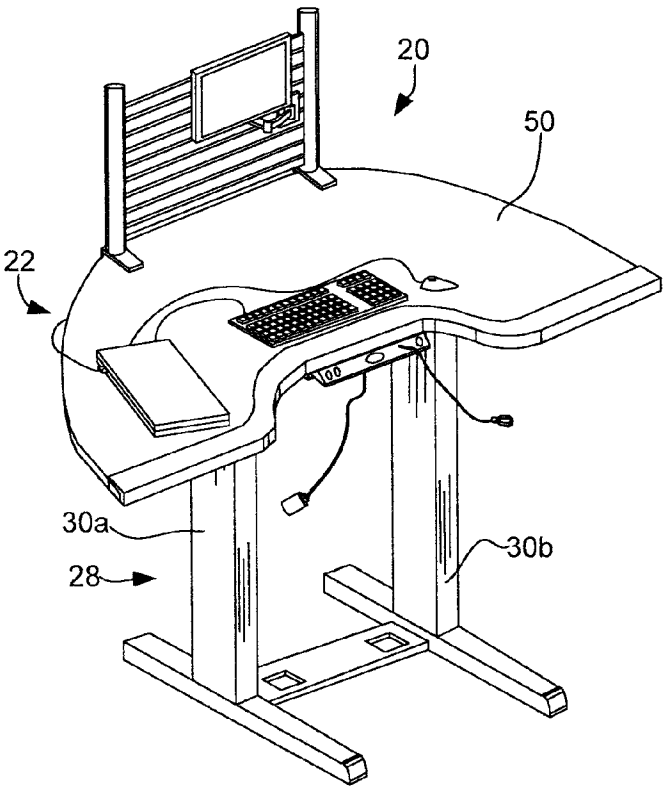
FIG. 12 is similar to FIG. 11, albeit showing a table assembly where support structures have been retracted.
Figure 11:
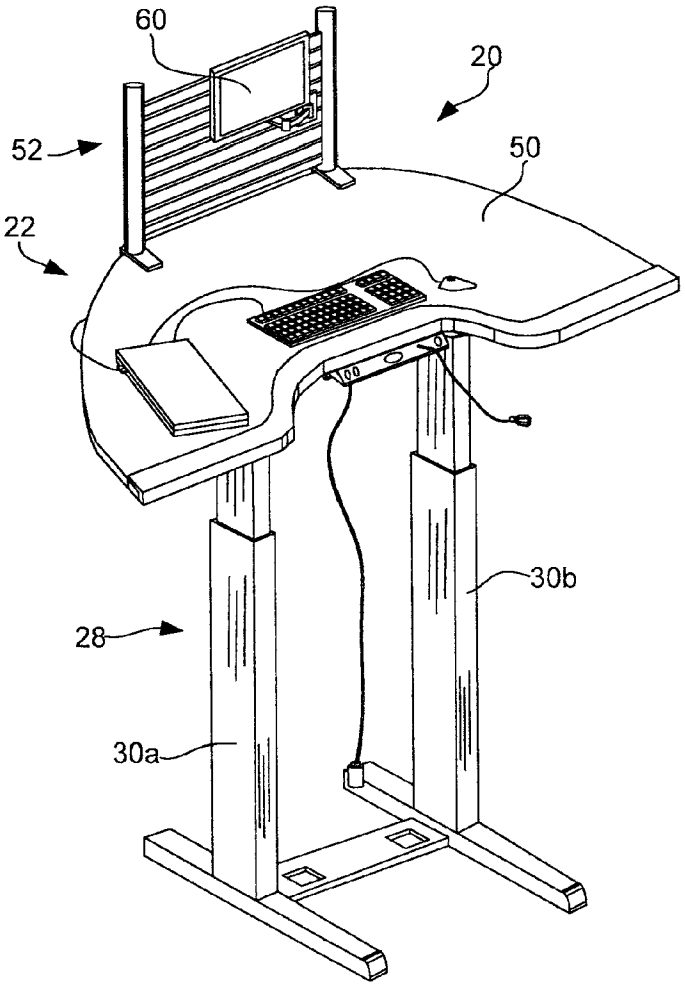
FIG. 11 is a view of the table assembly of FIG. 1 where support structures are extended.

Referring now to FIGS. 11 and 12, height adjustable support structure 28 is useable to adjust the height of top member 50 and other components (e.g., the slat wall assembly 52, display 60, etc., supported thereby to accommodate workstation users of different height. To this end, leg subassemblies 30*a*, 30*b* can be extended as in FIG. 11 or retracted as in FIG. 12 and can be adjusted to any height in between the range of heights illustrated.

Figure 6:
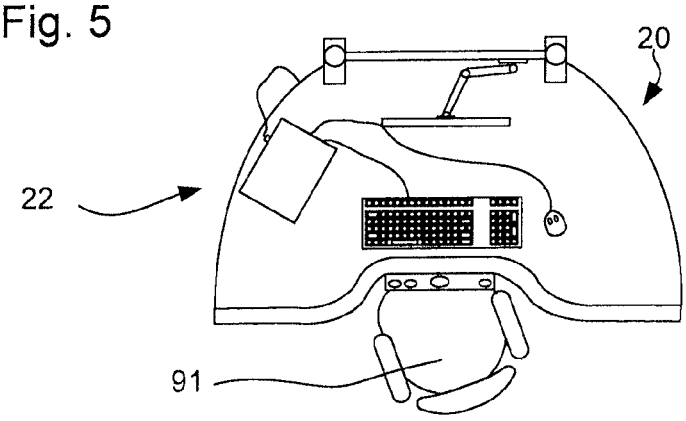
FIG. 6 is a top plan view similar to the view of FIG. 5, albeit showing the table assembly of FIG. 1 in use with a chair.

Referring now to FIG. 10, here, cable 160 can be disconnected from assembly 24 and a user can lift up on front end 166 of structure 164 and pull assembly 24 from crossbar member 38 so that wheels 180 (see again FIG. 9) roll out of openings 39 and assembly 24 can be separated from assembly 22. Referring also to FIG. 6, once treadmill assembly 24 has been removed, a chair 91 may be used with table assembly 22.

Here, to accommodate a typical chair height, table top height may be downwardly adjusted (see again FIG. 12).

Figure 13:
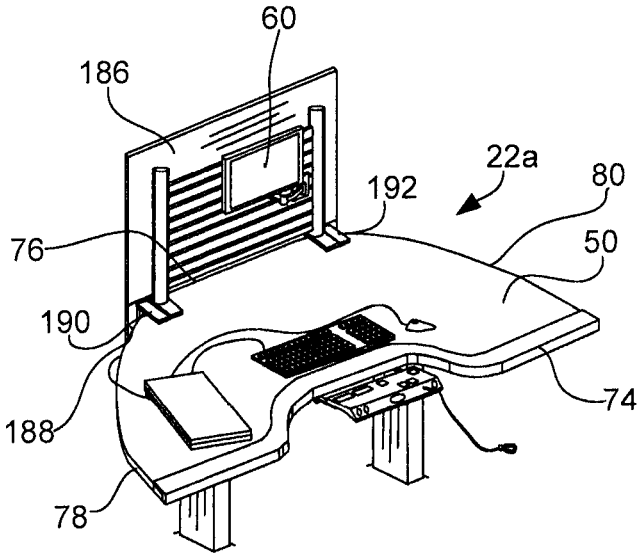
FIG. 13 is a perspective view similar to the view shown in FIG. 3, albeit where a privacy screen and a modesty screen have been mounted to a rear edge of a tabletop member.
Figure 14:
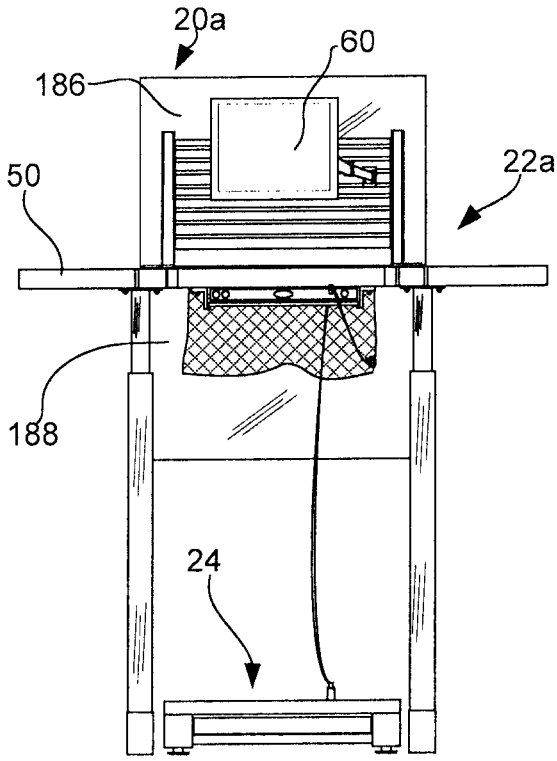
FIG. 14 is a front plan view of the assembly of FIG. 13.

Referring now to FIGS. 13 and 14, a workstation assembly 20*a* that is similar to station 20 described above is illustrated that includes a table assembly 22*a* and a treadmill assembly 24. The primary difference between station 20*a* and station 20 described above is that station 20*a* includes both a privacy panel 186 and a modesty panel 188 that are mounted to rear edge 76 of top member 50. As shown, privacy panel 186 is a rectilinear and substantially planar member that extends along the length of rear edge 76 and extends generally upward therefrom. Similarly, modesty panel 188 is a rectilinear and substantially planar member that extends along substantially the entire rear edge 76 and extends generally upward therefrom. Panels 186 and 188 may be mounted to rear edge 76 in any manner known in the art. In the illustrated embodiment, panels 186 and 188 are mounted to rear edge 76 via first and second C-shaped bracket assemblies 190 and 192 that are similar to bracket assemblies 120 and 122 described above with respect to FIG. 1. Because bracket assemblies 190 and 192 are similar to assemblies 120 and 122 described above, assemblies 190 and 192 will not be described here.

Although not shown, in at least some other additional embodiments it is contemplated that additional modesty and/or privacy panels may be mounted along one, both or portions of lateral edges 78 and 80 to provide additional privacy to a station user. In addition is should be appreciated that either of the modesty panel 188 or the privacy panel 186 may be mounted to rear edge 76 independent of the other panel.

Figure 15:
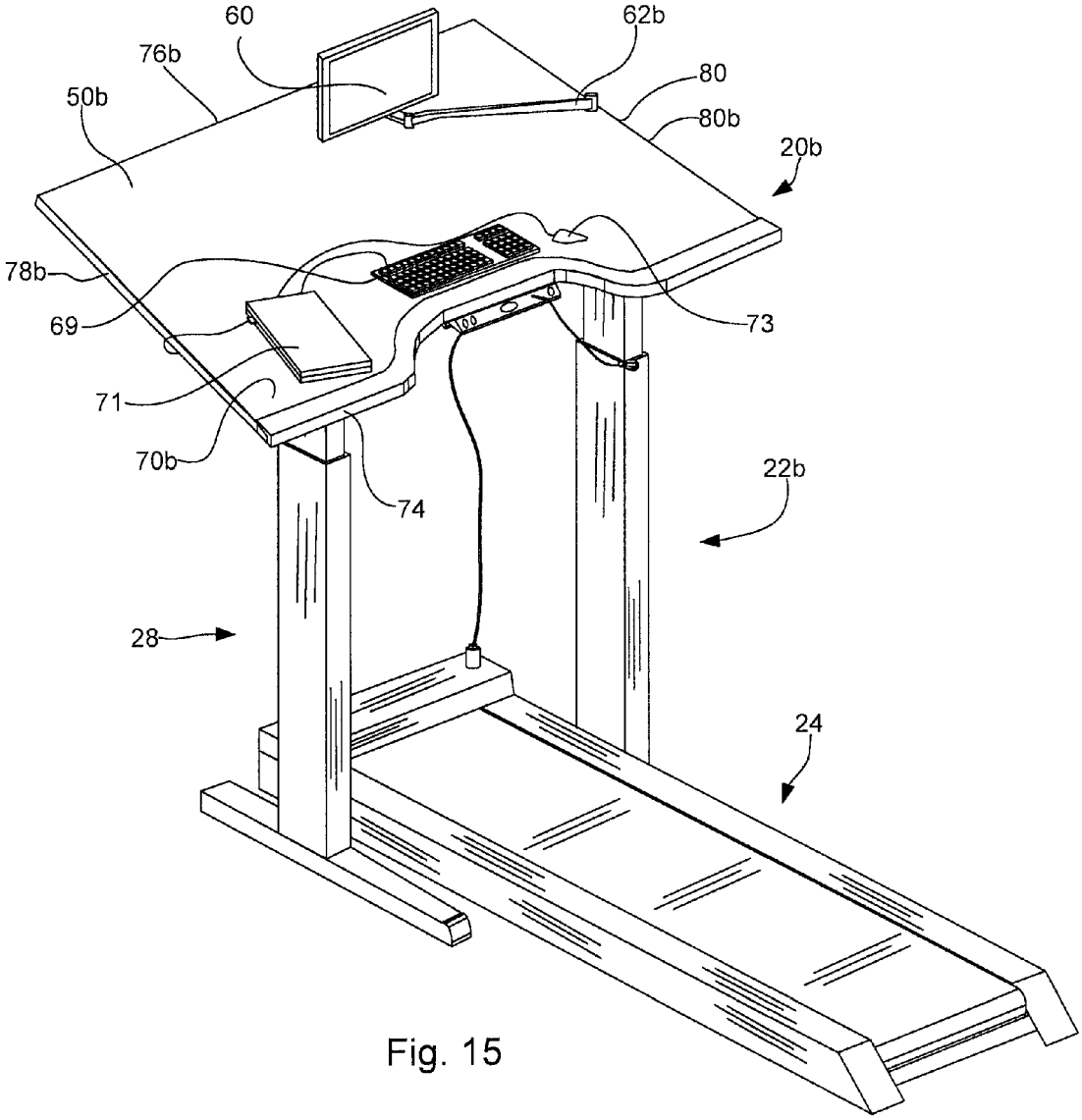
FIG. 15 is a view similar to the view of FIG. 1, albeit showing a second table/treadmill assembly.
Figure 16:
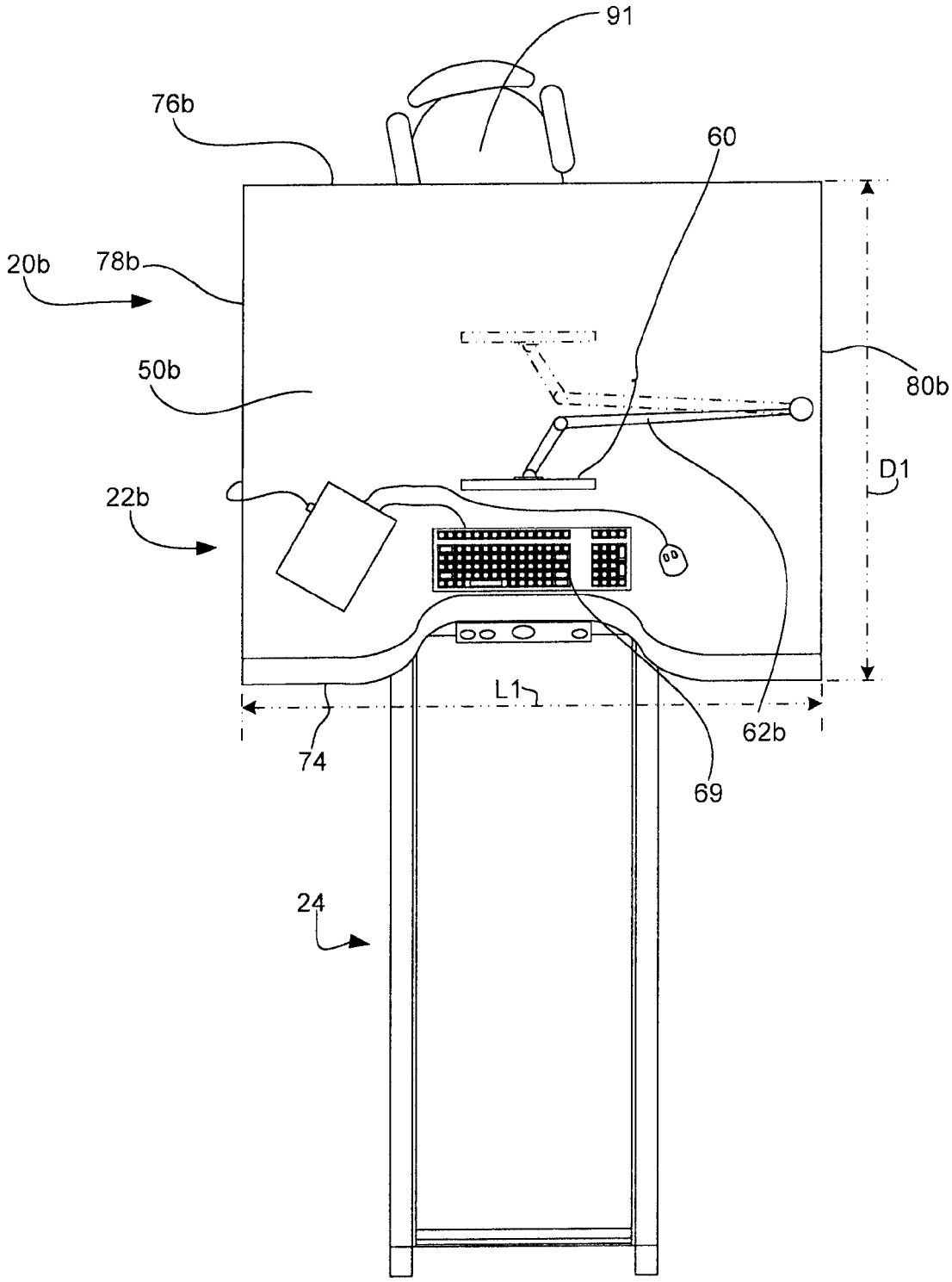
FIG. 16 is a top plan view of the assembly of FIG. 15.

Referring now to FIGS. 15 and 16, a third exemplary workstation embodiment 20*b* is illustrated that includes a treadmill assembly 24 akin to assembly 24 described above and a table assembly 22*b*. Here, table assembly 22*b* is similar to the assembly 22 described above with a few differences. A most obvious difference between table assembly 22*b* and assembly 22 described above is that table assembly 22*b* includes a top member 50*b* that has a different shape. Top member 50*b* has a generally rectilinear shape including a front edge 74, a straight rear edge 76*b* and first and second substantially straight lateral edges 78*b* and 80*b*, respectively. Here, top member 50*b* has a depth dimension D1 that is substantially equal to the length dimension L1 (e.g., four to six feet) of front edge 74.

The second major difference between assemblies 22*b* and 22 is that assembly 22*b* does not include a slat wall subassembly 52. Instead, a flat panel monitor 60 is mounted to a top surface 70*b* of member 50*b* via an articulating arm 62*b* so that the display screen 60 can be oriented to face either front edge 74 or rear edge 76*b*. In this case, as shown in FIG. 16, a station user may either use treadmill assembly 24 adjacent front edge 74 or, in the alternative, may lower table top member 50*b* to a height suitable for use with a chair 91 and may use chair 91 adjacent rear edge 76*b*. In still one other useful way, while a first station user uses treadmill assembly 24, a second station user may stand along side rear edge 76*b* and use the rear half of top member 50*b* to perform work activities and/or to converse with the first user on assembly 24.

Figure 17:
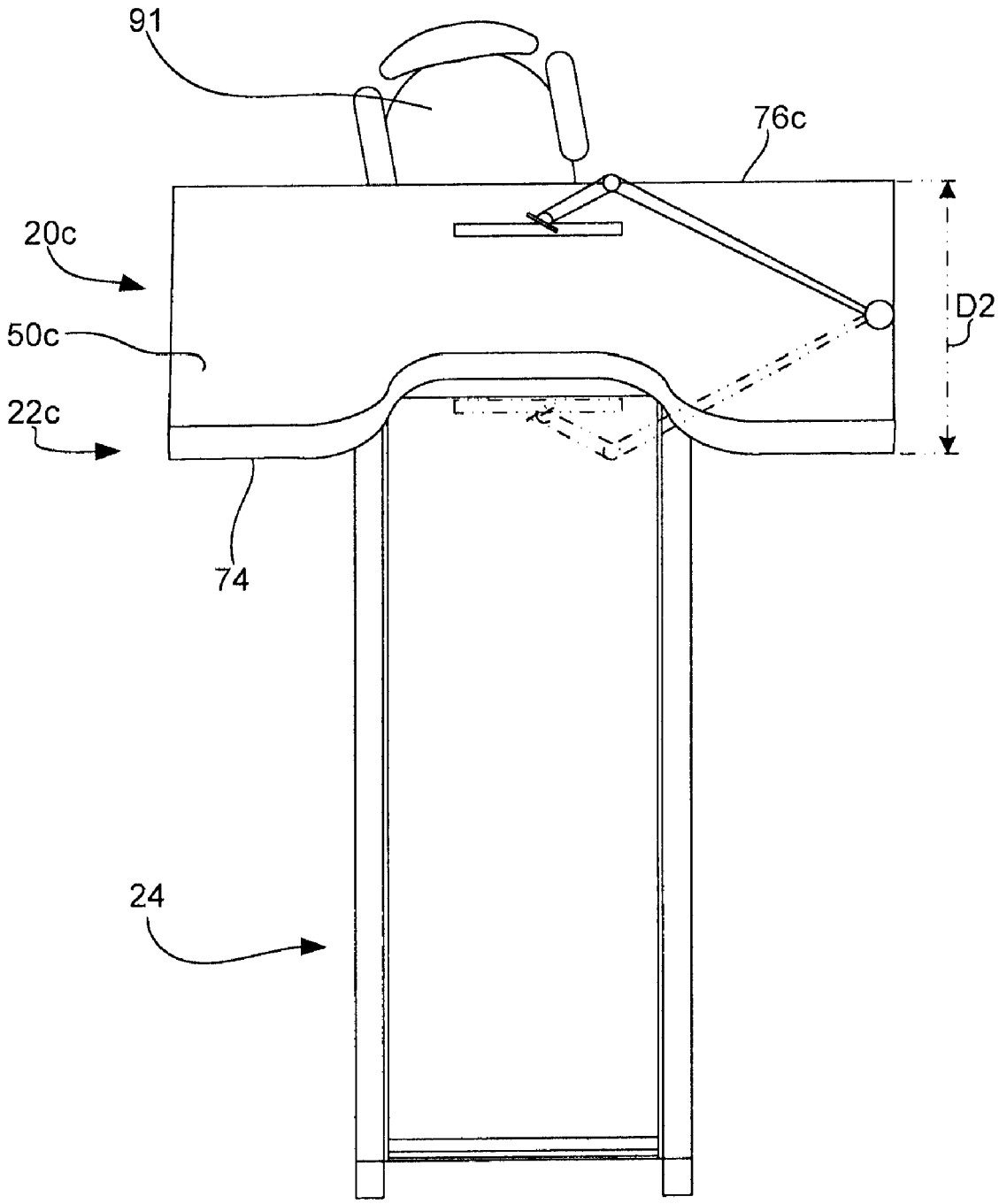
FIG. 17 is a top plan view similar to the view of FIG. 16, albeit showing an assembly having a different type of tabletop.

Referring now to FIG. 17, yet one additional workstation assembly 20*c* is illustrated that is similar to station 20*b* described above. Here, the primary difference between stations 20*c* and 20*b* is that station 20*c* has a table top member 50*c* where a depth dimension D2 thereof is approximately half the depth dimension D1 described above with respect to FIG. 16. In this case, a station user may either use treadmill assembly 24 adjacent front edge 74 or may use top member 50*c* adjacent a rear edge 76*c*.

Figure 18:
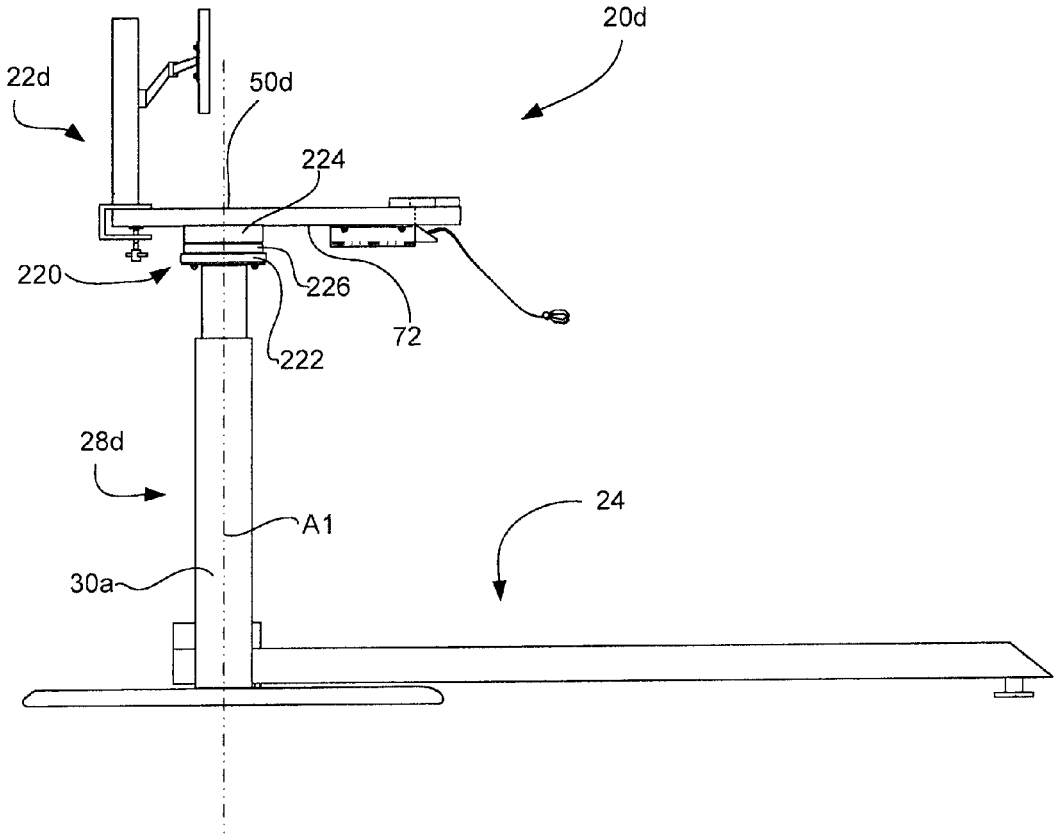
FIG. 18 is a side plan view of yet another workstation assembly consistent with at least some aspects of the present invention.
Figure 19:
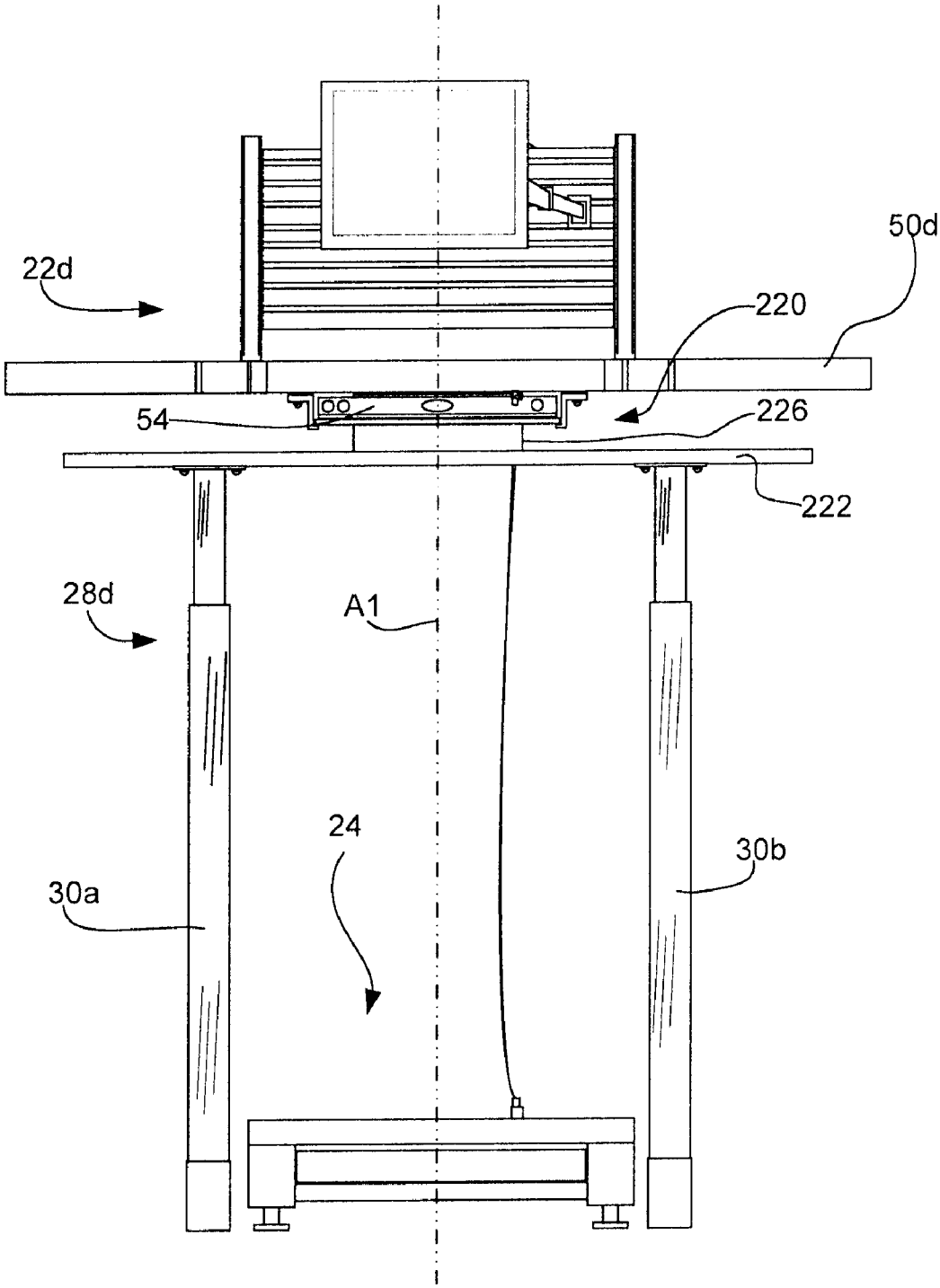
FIG. 19 is a front plan view of the assembly of FIG. 18.
Figure 21:
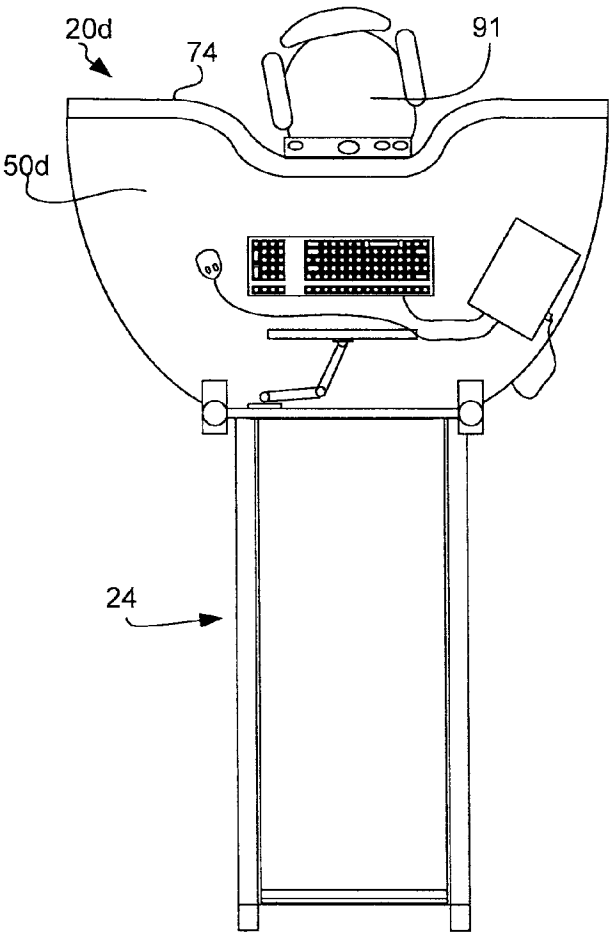
FIG. 21 is similar to FIG. 20, albeit where a tabletop and associated components have been rotated through 180 degrees.
Figure 20:
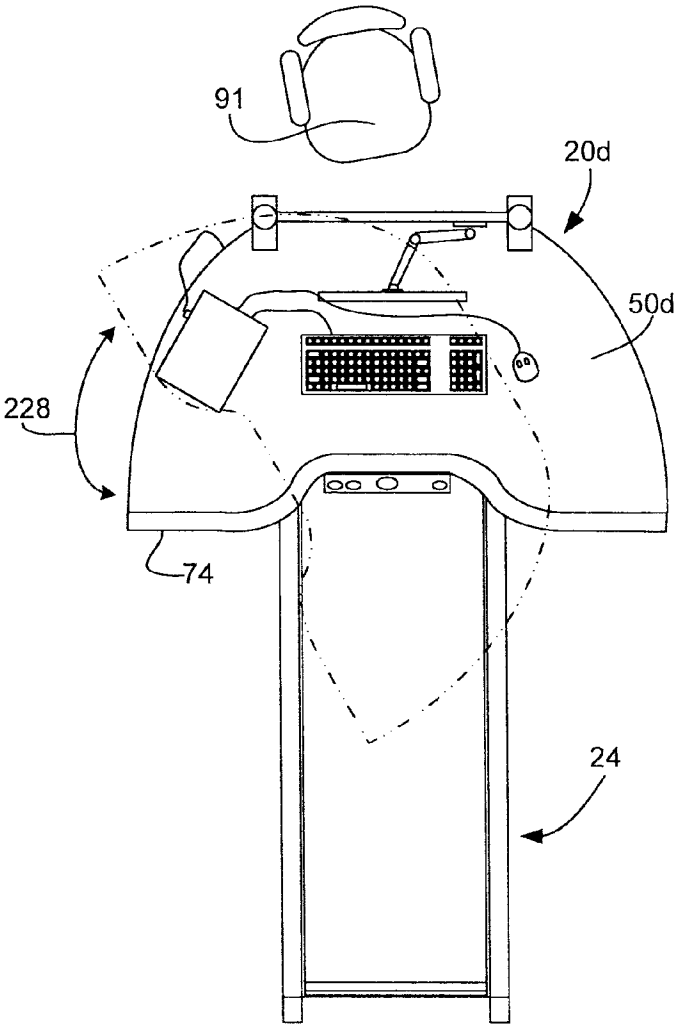
FIG. 20 is a top plan view of the assembly of FIG. 18, albeit including a chair.

Referring now to FIG. 18, an additional workstation assembly 20*d* is shown that includes a treadmill assembly 24 and a different type of table assembly 22*d*. Here, the primary difference between table assembly 22*d* and assembly 22 described above is that a pivot assembly 220 is disposed between a height adjustable support structure 28*d* and a table top member 50*d*. Pivot assembly 220 includes a top cross-bar 222, a top pivot plate 224 and a bottom pivot plate 226. Top cross-bar 222 is secured to and extends between the top ends of leg subassemblies 30*a* and 30*b* as best shown in FIG. 19. Bottom pivot plate 226 is mounted centrally along the length of top cross-bar 222 and top pivot plate 224 is mounted to undersurface 72 of top member 50*d* at a generally central location. Plates 224 and 226 mate and facilitate rotation about a vertical pivot axis A1. Here, plates 224 and 226 may include ball-bearing races or the like to facilitate easy rotation or any other type of structure known in the art that facilitates rotation between two plate members. In addition, the plates may includes some type of rotation limiting structure and/or some type of juxtaposition maintaining structure that maintains the plates in specific orientations with respect to each other unless affirmatively moved. Moreover, some type of a position locking mechanism may be provided to maintain specific plate orientations that effectively lock top member 50*d* with respect to support structure 28*d* in either one of the rearward of forward facing directions shown in FIGS. 20 and 21. In operation, as shown in FIGS. 20 and 21, top member 50*d* may be oriented for use by a station user on treadmill 24 (see FIG. 20) or for use by a user using seat 91 by rotating top member 50*d* as shown by arrow 228.

Figure 22:
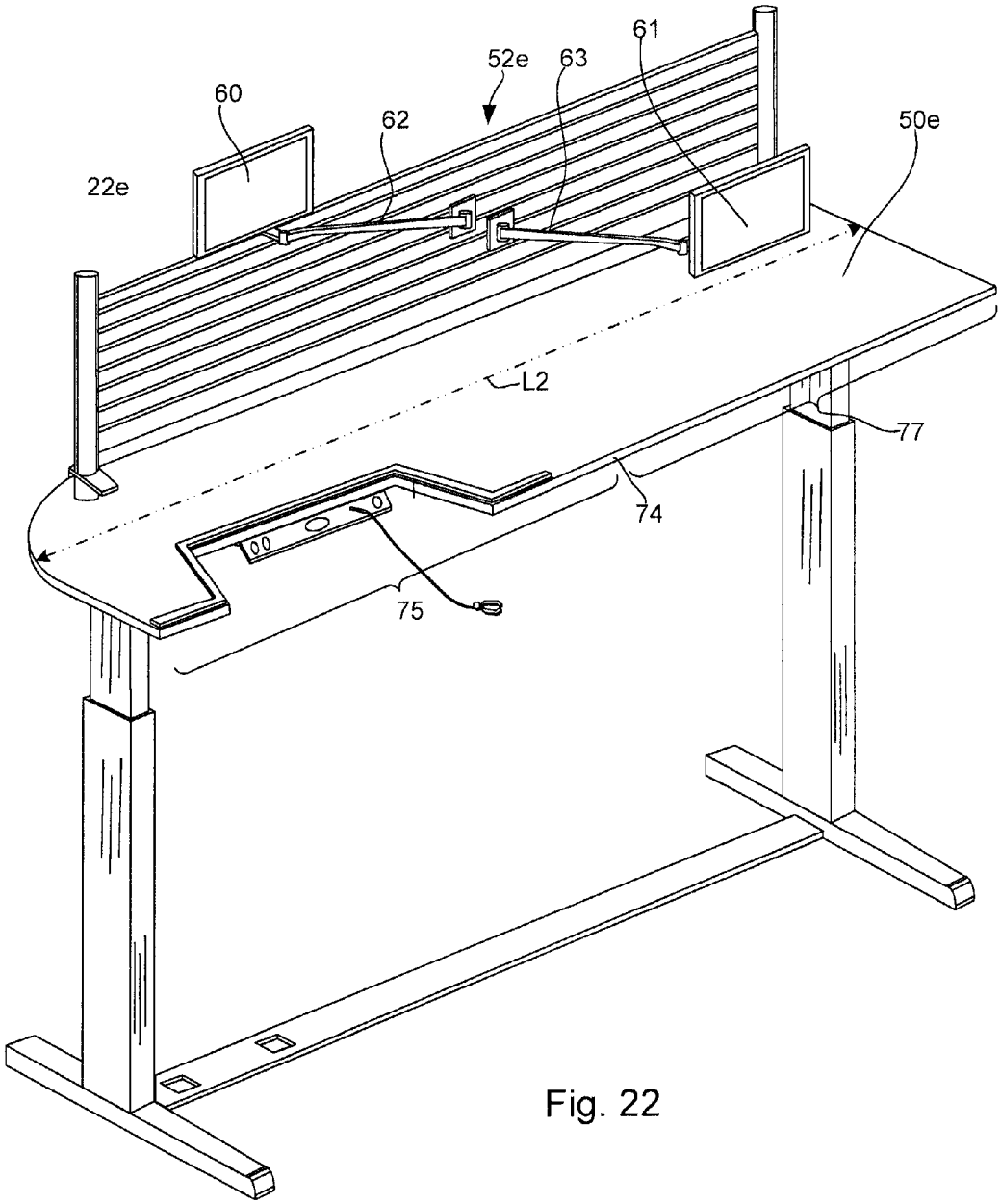
FIG. 22 is a perspective view of yet another table assembly consistent with at least some aspects of the present invention.

Referring now to FIG. 22, an additional table assembly 22*e* is shown that includes a top member 50*e* having a length dimension L2 that is substantially greater than the length dimension L1 of the top member 50 described above with respect to FIGS. 1 through 12. Here, top member 50*e* is configured to accommodate a user along a first portion 75 that may use a treadmill assembly (not illustrated in FIG. 22) and a second portion 77 at which a user standing or using a chair may work. In this case, an articulating arm 62 may support a display 60 at locations adjacent either portions 75 or 77 of the front edge 74. In the alternative, an additional articulating arm 63 and display 61 may be provided so that separate displays can be simultaneously located adjacent edge portions 75 and 77. In FIG. 22, slat wall assembly 52*e* has a length dimension similar to the length L2 of top member 50*e*. Although not shown, in other embodiments, a flat panel display screen may be mounted to slat wall assembly 52*e* for sliding movement there along.

Figure 23:
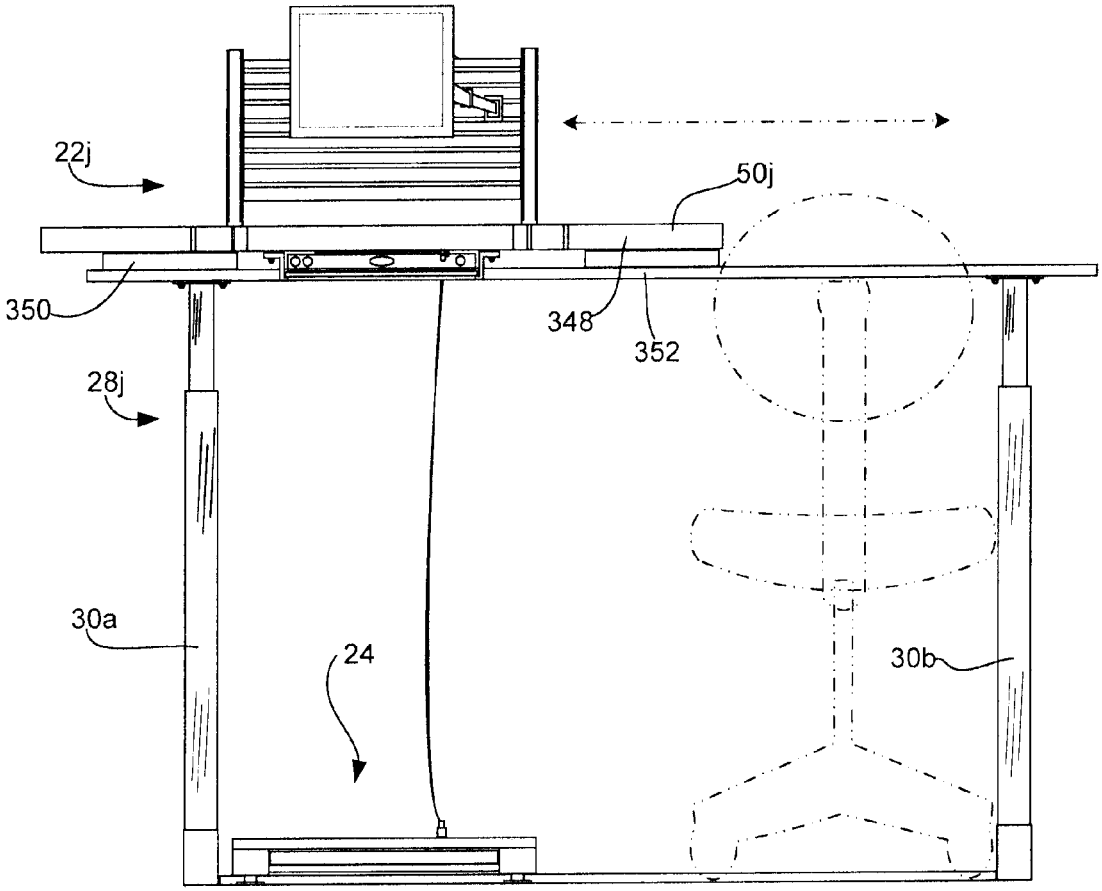
FIG. 23 is a front plan view of another station, albeit including a sliding table subassembly.

Referring now to FIG. 23, yet one other workstation assembly 22*j* is illustrated that includes a treadmill assembly 24 and a table assembly 22*j*. Here, table assembly 22*j* includes a horizontal track 352 that extends between top ends of leg subassemblies 30*a* and 30*b* and first and second trolleys 350 and 352 received in the track for sliding movement thereal-ong. Track 352 is approximately twice the length of the front edge of top member 50*j*. Trolleys 350 and 352 are mounted to the underside of top member 50*j* so that top member 50*j* can be slid along track 352 to the treadmill use location shown or to a location adjacent the chair 91 shown in phantom as indicated by arrow 369. Although not shown, a releasable locking mechanism may be provided for locking the table top 50*j* in any use position.

Figure 24:
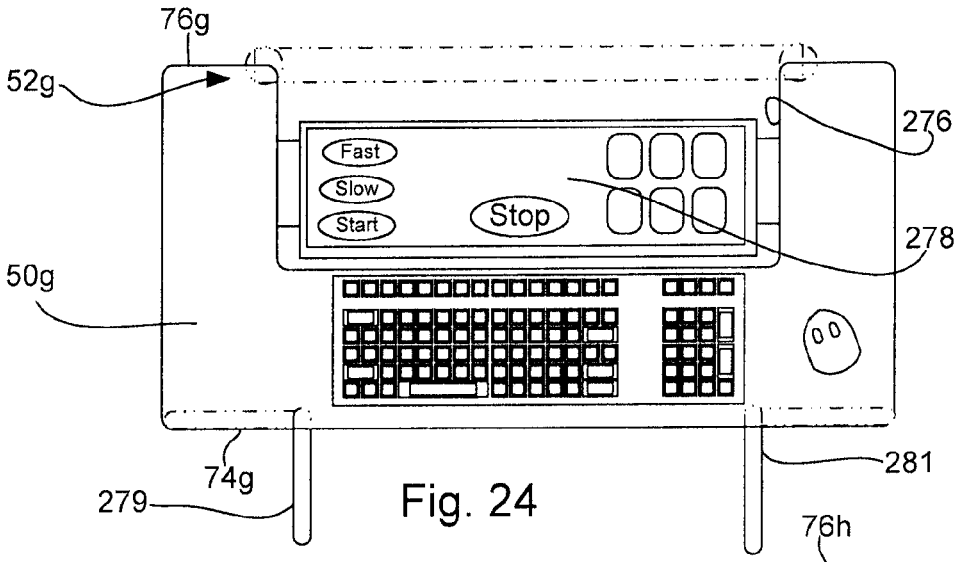
FIG. 24 is a top plan view of yet another table assembly.
Figure 25:
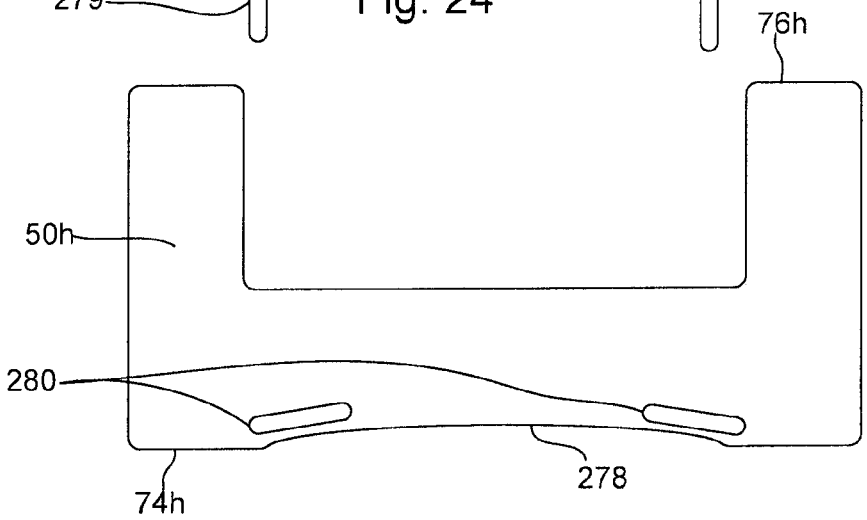
FIG. 25 is a top plan view of an additional table top member.

Referring to FIG. 24, a top plan view of an additional table top member 50*g* is shown that includes substantial parallel front and rear edges 74*g* and 76, respectively. A recess or cutout 276 is formed in rear edge 76*g* in which a control assembly interface 278 may be mounted via brackets 279, a tray, or other mechanical structure for use by a station user. Here, between recess 276 and front edge 74*g*, a keyboard and mouse or other input devices as well as other materials used by the station user may be supported.

Referring still to FIG. 24, pivoting handle members 279 and 281 are illustrated where each handle member 279 and 281 is a rigid elongated member mounted for pivotal motion to the undersurface (not labeled in FIG. 24) of top member 50*g*. In FIG. 24 the handle members are shown in phantom below the member 50*g* in a stored location and are also shown in a use position. Here, it is contemplated that some type of releasable mechanical locking mechanism would be provided to lock handle 279 and 280 in the use position shown in FIG. 24. Referring once again to FIG. 24, also shown in phantom is a slat wall assembly 52*g* mounted to the rear edge 76*g* that effectively straddles the cutout/recess 276. Here, assembly 52*g* is shown in phantom so the shape of the top member can more easily be appreciated.

shape described above with respect to FIG. 24 except that the front edge 74*h* forms a cutout or slight recess 278 for accommodating a station user or the like. In addition, handle recesses 280 or openings are formed adjacent edge 74*h* to perform a function similar to that described above with respect to handle member 54 (see again FIG. 1). Here, the recesses 280 are only located along portions of front edge 74*h*. In other embodiments it is contemplated that a recess may be formed along the entire front edge 74*h*.

Figure 26:
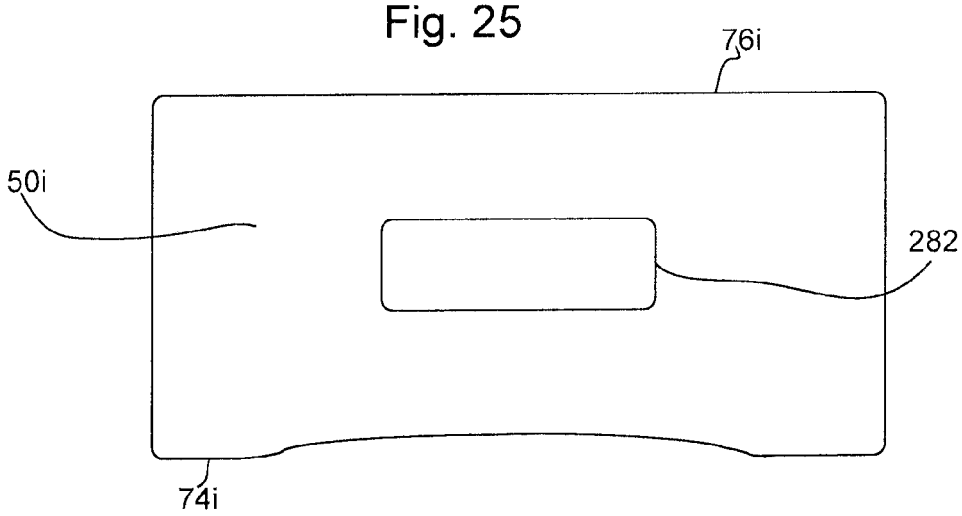
FIG. 26 is a top plan view of yet one more table top member consistent with at least some aspects of the present invention.

Referring now to FIG. 26, one additional table top member 50*i* is shown that includes substantially straight front and rear edges 74*i* and 76*i* where a cutout 282 is formed centrally within top member 50*i*. Here, although not illustrated, a control assembly interface akin to interface 278 described above with respect to FIG. 24 may be mounted within or slightly below cutout 282.

Figure 27:
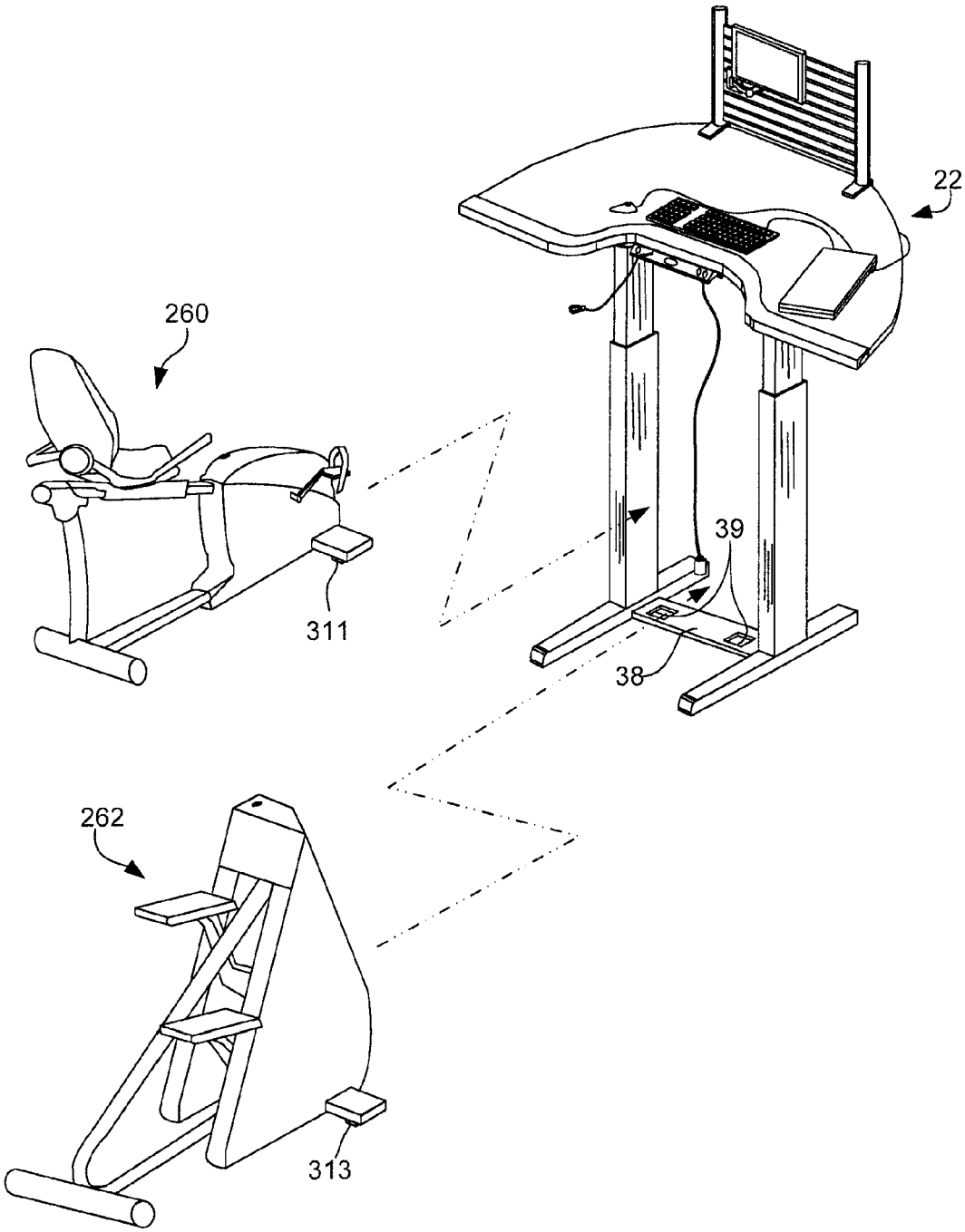
FIG. 27 is a perspective view showing a table assembly like the one shown in FIG. 1, albeit where either a recumbent bike or a stair climber can be used with the table assembly.

While the above embodiments are described in the context of a workstation that includes a treadmill assembly, it is contemplated that other types of exercise equipment, including but not limited to a recumbent bike 260, a stair stepper assembly 262, or an elliptical trainer assembly (not shown), may be used in conjunction with any one of the table assemblies described above to achieve similar results. To this end, referring now to FIG. 27, a table assembly 22 is shown in conjunction with recumbent bike assembly 260 and stair-stepper assembly 262 where, as indicated by the figure, either of assemblies 260 or 262 may be used with table assembly 22. In this case, the height of the top member 50 may have to be adjusted differently depending on which of the assemblies 260 or 262 is used with table assembly 22. In at least some embodiments it is contemplated that either of assemblies 260 or 262 will couple to table assembly 22 in a manner similar to that described above with respect station 20. To this end, assembly 22 includes crossbar 38 that forms coupling openings 39, assembly 260 includes coupling structure 311 (e.g., square pegs) and assembly 262 includes coupling structure 313 where structures 311 and 313 are receivable within openings 39 to link assemblies 260 and 262, respectively, to member 38.

Figure 28:
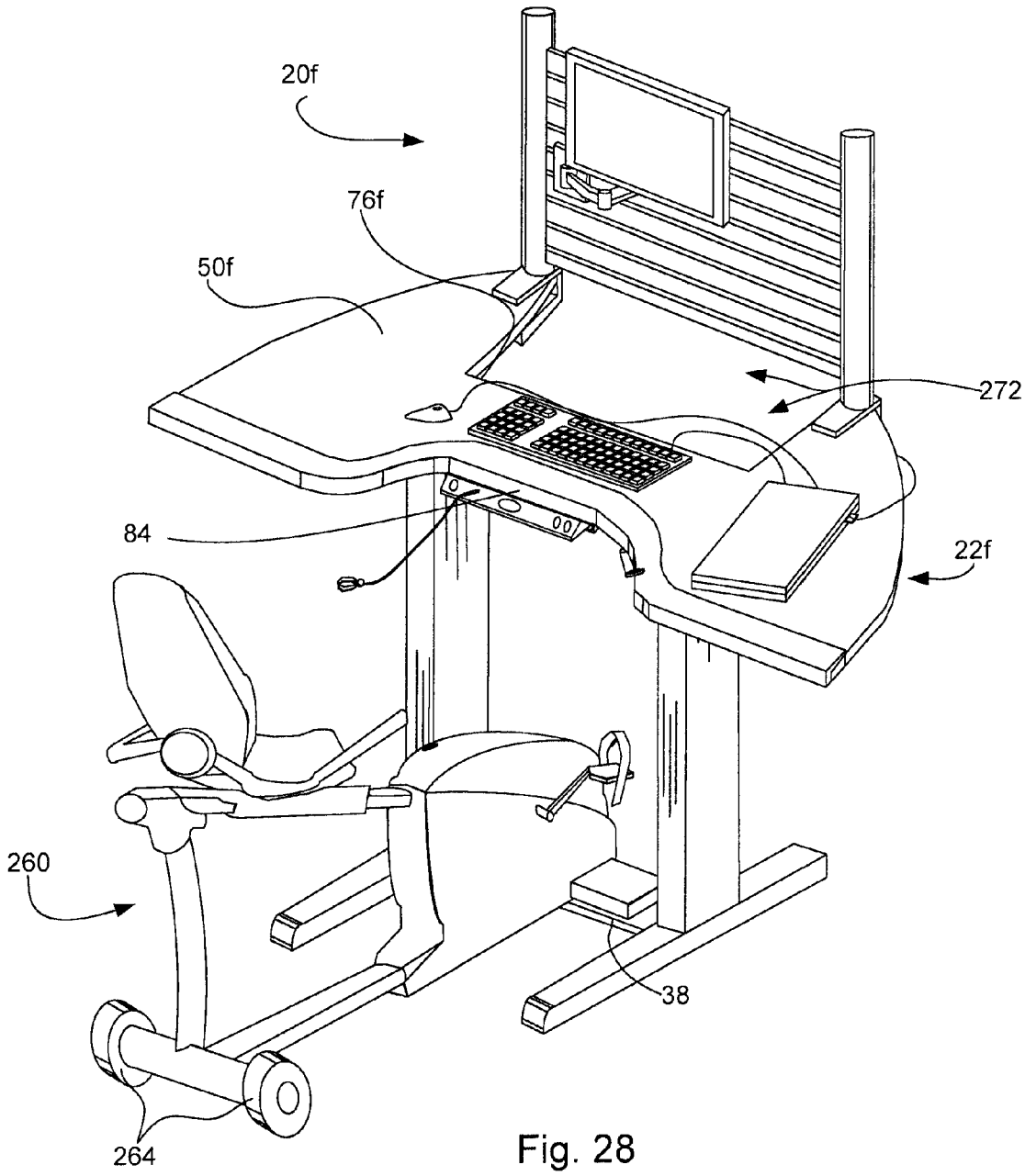
FIG. 28 shows yet another table assembly in conjunction with a recumbent bike.

Referring now to FIG. 28, an additional workstation 20*f* is shown that includes recumbent bike 260 and a table assembly 22*f*. Here, assembly 22*f* is similar to assembly 22 described above with the primary difference between assembly 22*f* and assembly 22 is that assembly 22*f* includes a top member 50*f* that forms a recess 272 in rear edge 76*f*. Here, recess 272 is provided at a location in which it is contemplated that a bike user's knees may reside at times while using recumbent bike 260. In this case, the dimension between front edge 84 of member 50*f* and rear edge 76*f* may be only sufficient to support a keyboard or the like.

Referring again to FIG. 1, in at least some embodiments a treadmill feedback device/module 95 may be provided that is supported above top surface 70 of top member 50. For instance, as illustrated in FIG. 1, module 95 may be mounted to a slat wall member 98 adjacent arm 62 for easy viewing by a treadmill user. Similarly, although not illustrated, a module 95 may be mounted to an edge of display 60 for easy viewing. In at least some cases module 95 will include visual readout devices such as numerical LED or LCD arrangements, a flat panel display, etc. In some embodiments it is contemplated that module 95 may also include input components (e.g., mechanical buttons, on display touch screen buttons, etc.) for selecting treadmill options and providing treadmill control input.

In other cases treadmill output and/or input tools may be provided via display screen 60 for heads-up access by a treadmill user. To this end, for instance, referring again to FIG. 3A, the interface may also include a "display status" button 251 that, when selected, causes a treadmill status window to open on display 60 to indicate the time of treadmill use, speed, time remaining, progress along a programmed treadmill cycle, etc. In some cases, where display 60 is touch sensitive, input buttons may also be provided via display 60. In some embodiments display 60 may always provide a treadmill output/input window or may provide output/input information within a side bar or frame portion of the display output so that the treadmill user can simultaneously access other information (e.g., a word processor document) via display 60.

One or more specific embodiments of the present invention have been described above. It should be appreciated that in the development of any such actual implementation, as in any engineering or design project, numerous implementation-specific decisions must be made to achieve the developers' specific goals, such as compliance with system-related and business related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Thus, the invention is to cover all modifications, equivalents, and alternatives falling within the spirit and scope of the invention as defined by the following appended claims. For example, while accessories including a cable trough assembly, a modesty panel and a privacy panel are described above as being mountable via brackets to table tops, other accessories are contemplated including receptacle and data port brackets, shelf brackets, a fan bracket, a laptop bracket, a slat wall bracket, etc.

To apprise the public of the scope of this invention, the following claims are made:

What is claimed is:

1. A treadmill assembly comprising:

a substantially horizontal tread assembly including oppositely extending front and rear ends, a tread, and a controller for controlling the tread;

a support structure extending proximate the rear end of the tread assembly to a distal top end substantially above the rear end of the tread assembly;

a table top member mounted to the distal top end of the support structure, the top member including a substantially flat work surface and a front edge, the work surface having dimensions suitable to support a computer keyboard;

a handle member supported by the table top member adjacent the front edge of the table top member; and a control assembly including at least one input button for providing command signals for controlling the controller, the control assembly supported by at least one of the table top member and the handle member adjacent the front edge of the table top member;

wherein the table top member includes an undersurface and wherein the control assembly is mounted to the undersurface of the table top member adjacent the front edge of the table top member and below the handle member.

2. The assembly of claim 1 wherein the control assembly includes a tray and wherein the tray is mounted to the undersurface of the table top member.

3. The assembly of claim 2, the control assembly further including a track secured to the undersurface of the table top member; and wherein the tray is mounted to the track for movement between a retracted position in which the control assembly is substantially below the undersurface and an extended position in which the control assembly is substantially upwardly exposed and adjacent the front edge of the table top member.

4. The assembly of claim 3 wherein, when the tray is in the retracted position, the at least one input button is upwardly exposed adjacent the front edge of the table top member.

5. The assembly of claim 4 wherein the control assembly further includes at least one output display residing below the undersurface of the table top member when the tray is in the retracted position and is upwardly exposed when the tray is in the extended position.

6. The assembly of claim 1 wherein the input button is substantially upwardly exposed adjacent the front edge of the table top member.

7. The assembly of claim 1 wherein the handle includes at least a first rib that extends from one of the work surface and the undersurface, the rib formed along at least a portion of the front edge of the table top member.

8. The assembly of claim 1 wherein the control assembly is formed within the handle.

9. The assembly of claim 1 wherein at least a portion of the front edge of the table top member is concave.

10. The assembly of claim 1 wherein the handle forms a wrist rest surface that resides above a work surface plane and the top surface of the table top member and the wrist rest surface are substantially horizontal surfaces.

11. The assembly of claim 10 wherein the wrist rest surface extends substantially along the entire length of the front edge of the table top member.

12. The assembly of claim 11 wherein the wrist rest surface has a depth dimension along the work surface adjacent the front edge of between one inch and three inches.

13. The assembly of claim 12 wherein the front edge is concave.

14. The assembly of claim 1 wherein the handle member is directly connected to the table top member.

15. The assembly of claim 1 wherein the handle assembly extends along the top surface of the table top member and substantially along the entire front edge of the table top member.

16. The assembly of claim 1 wherein the handle assembly extends along substantially the entire length of the front edge of the table top member.

17. The assembly of claim 1 further including a computer keyboard supported on a top surface of the table top member.

* * * * *